US008316934B2

(12) United States Patent
Pietrobon

(10) Patent No.: US 8,316,934 B2
(45) Date of Patent: Nov. 27, 2012

(54) ISOTOPIC IDENTIFICATION OF PRODUCTION BY INDIVIDUAL FORMATIONS IN COMMINGLED GAS WELLS

(75) Inventor: Marney N. Pietrobon, Anchorage, AK (US)

(73) Assignee: BP Corporation North America Inc., Houston, TX (US)

( * ) Notice: Subject to any disclaimer, the term of this patent is extended or adjusted under 35 U.S.C. 154(b) by 281 days.

(21) Appl. No.: 12/817,912

(22) Filed: Jun. 17, 2010

(65) Prior Publication Data

US 2010/0326651 A1 Dec. 30, 2010

Related U.S. Application Data

(60) Provisional application No. 61/221,848, filed on Jun. 30, 2009.

(51) Int. Cl.
*E21B 49/08* (2006.01)

(52) U.S. Cl. ..... 166/250.01; 166/250.15; 166/264

(58) Field of Classification Search ..... 166/250.01, 166/250.15, 264
See application file for complete search history.

(56) References Cited

U.S. PATENT DOCUMENTS

| | | | | |
|---|---|---|---|---|
| 3,239,666 | A | 3/1966 | Newton et al. | |
| 7,644,993 | B2 * | 1/2010 | Kaminsky et al. | 299/5 |
| 2008/0135236 | A1 | 6/2008 | Schoell | |

OTHER PUBLICATIONS

PCT International Search Report and Written Opinion of the International Searching Authority issue in related application No. PCT/US2010/038997, mailed May 12, 2011, 12 pages.

Schoell, Martin, et. al., Isotope Analyses of Gases in Gas Field and Gas Storage Operations, SPE International, Jun. 30, 1993, pp. 337-344, 26171, Society of Petroleum Engineers, Richardson, TX, USA.

Bazan, L.W., The Allocation of Gas Well Production Data Using Isotope Analysis, SPE International, Mar. 18, 1998, pp. 1-9, 40032, Society of Petroleum Engineers, Richardson, TX, USA.

Urbina, Rafael, et. al., Stable Isotope Relations in the Characterization of Giant Complex Reservoirs, SPE International, Feb. 7, 2003, 1-4, 80272, Society of Petroleum Engineers, Richardson, TX, USA.

* cited by examiner

*Primary Examiner* — William P Neuder
(74) *Attorney, Agent, or Firm* — Albert K. Shung

(57) ABSTRACT

A computer system and computerized method for allocating production among multiple formations produced by a hydrocarbon well, using isotopic concentration analysis. According to an aspect of the system and method, multiple single-formation isotopic concentration measurements of multiple hydrocarbon gases are taken from each formation. Within each formation, groups of similar isotopic concentration values are defined, and are mapped to geographic regions of the formations. Mixing equations are developed between regions of the different formations, for use in allocating production for a well intersecting those regions. According to another aspect of the system and method, allocation among three or more formations is performed using Monte Carlo analysis of an underspecified mixing equation, and at a measured isotopic concentration value for the commingled flow from the well.

16 Claims, 15 Drawing Sheets

FM 6 ENDPOINT

CONTRIBUTION FROM FORMATION 6
1.0
0.9
0.8
0.7
0.6
0.5
0.4
0.3
0.2
0.1
0.0
FM 14 ENDPOINT
FM 10 ENDPOINT
-48
-46
-44
-42
-40
-38
-36
δ comm FM 14 ENDPOINT
CONTRIBUTION FROM FORMATION 14
1.0
0.9
0.8
0.7
0.6
0.5
0.4
0.3
0.2
0.1
0.0
FM 6
ENDPOINT
FM 10 ENDPOINT
-48
-46
-44
-42
-40
-38
-36
δ comm

ISOTOPIC IDENTIFICATION OF PRODUCTION BY INDIVIDUAL FORMATIONS IN COMMINGLED GAS WELLS

CROSS-REFERENCE TO RELATED APPLICATIONS

The present application claims the benefit of U.S. Provisional Application Ser. No. 61/221,848, filed Jun. 30, 2009, herein incorporated in its entirety for all purposes.

STATEMENT REGARDING FEDERALLY SPONSORED RESEARCH OR DEVELOPMENT

Not applicable.

BACKGROUND OF THE INVENTION

This invention is in the field of hydrocarbon (i.e., oil and gas) production. Embodiments of this invention are more specifically directed to the analysis of hydrocarbons produced from each of multiple formations exploited by a common well.

It is commonplace, in modern production fields, for individual wells to produce hydrocarbons (i.e., oil and natural gas) from multiple formations in the earth, by way of perforations in the wellbore at various depths along its length. Knowledge of the hydrocarbon output produced from each of these multiple formations is extremely useful information in managing individual wells, and in managing the exploitation of the reservoir as a whole. In addition, in some locations, regulations require the allocation of production to individual formations for the payment of royalties. Typically, only the commingled flow rate from of the formations produced by the well is available, because there is often no economically practical way to directly measure the production from the individual formations. This difficulty is especially true in those formations referred to in the art as "tight gas formations", in which the gas-bearing strata are not well-defined, and in which open hole production techniques are used (with all perforations open along the producing length of the wellbore).

As such, sampled measurement of the output of the individual formations is the usual basis for allocating the commingled flow among the individual producing formations. A typical conventional approach to this allocation involves limiting the produced oil and gas to that from a single one of the formations along the wellbore, in isolation from the other formations, for example by inserting packers along the wellbore. Once isolated, any flow to the surface from that formation is measured. The formation is then stimulated and the flow from the isolated formation is then measured over a period of hours (e.g., eight to twelve hours) directly after that stimulation. This flow will be at a higher pressure than under normal producing conditions, which enables the analyst to estimate a flow versus pressure characteristic for the formation. These measurements are repeated for each of the formations into which the wellbore extends, in isolation from the other formations. One can then estimate the allocation from each of the multiple formations, for a measured commingled flow rate, from a combination of these estimated characteristics.

However, this conventional method has several disadvantages. One significant disadvantage is that the allocation measurement is not made under the actual flow conditions of production into a pipeline. As such, the effects of pipeline backpressure, and of differences in the flow path presented by production and pipeline tubing, are not included in the measurement and estimation. In addition, this measurement and allocation method is typically only performed once during the life of the well, because of the high cost of performing the test, including the loss of production. Changes in production from the various formations over time are thus not considered in this conventional allocation technique. In other words, error is inherently present in the original flow rate allocation, and this error is not only maintained over the life of the well cascades to other calculations for the well.

Another conventional approach to allocation of production among multiple formations is to measure the oil and gas flow for an extended period, such as thirty days, after the well has been completed to the depth of each formation. By way of subtraction of each formation's contribution as the next stage of the well is completed, one can arrive at an estimate of the relative contributions of each formation to the commingled flow. However, this approach is also subject to substantial error, considering that the pressure at which the earlier measurements are made can change as the well is completed at additional formations. In addition, this measurement approach is also performed only at the initial completion of the well, and as such cannot comprehend changes in production over time.

Differences in the compositional attributes of gas produced from different formations are observable. One such gas composition attribute that can differ among formations is the concentration of heavy isotopes of carbon and hydrogen in the gas itself. For example, the ratios of heavy carbon $^{13}C$ to stable carbon $^{12}C$, and of heavy hydrogen $^{2}H$ (or deuterium, D) to stable hydrogen $^{1}H$, in each of several gas components (methane, ethane, propane, isobutane, n-butane, etc.), depend on the manner and era in which the gas was formed, and thus from formation to formation. These isotopic concentration ratios are measurable to a high degree of accuracy, by conventional equipment.

Accordingly, the allocation of production between two formations that produce through the same well, using isotopic concentration ratios, is known in the art. In a conventional approach, the isotopic concentration ratios in one or more gas components are measured from each of the two formations, individually. Endpoints of a "mixing curve" between the two formations are derived from the measured elemental isotope ratio (e.g., $^{13}C$ to $^{12}C$) for a gas component (e.g., ethane, or "C2") for the two cases of 100% production from each of the formations. Either by assuming a linear relationship between these endpoints, or by otherwise deriving a function between these endpoints, a mixing curve of the production percentage from one of the formations as a function of measured commingled isotopic concentration ratio can be derived. One can obtain the relative allocation of gas production from the two formations based on samples of the commingled production gas. This conventional allocation method can also be used for allocating oil production, as the isotopic concentrations of natural gas entrained in the oil output can be analyzed in this manner.

However, it has been observed, according to this invention, that a given formation can have various producing regions, at different depths, and that these producing regions can exhibit isotopic concentrations that vary significantly among one another. For such formations, conventional isotopic allocation methods have been observed to involve significant error, because of the spread of the values of isotopic concentration within the formation.

In addition, this simple method does not work in the case of commingled flow from more than two formations, because it does not yield a unique allocation result from the measured isotope ratio of the commingled flow from three or more formations.

BRIEF SUMMARY OF THE INVENTION

Embodiments of this invention provide a method and system for efficiently and accurately allocating gas produced from a commingled well, among the multiple formations producing into that well.

Embodiments of this invention provide such a method and system that is applicable to commingled wells producing from three or more formations.

Embodiments of this invention provide such a method and system that accurately characterizes different regions of the producing formations, and uses this accurate characterization in the allocation of commingled gas to those formations.

Embodiments of this invention provide such a method and system that correlates well with surveys and other extrinsic data pertaining to the sub-surface lithology.

Other objects and advantages of embodiments of this invention will be apparent to those of ordinary skill in the art having reference to the following specification together with its drawings.

An embodiment of this invention is implemented in a computerized analysis method, and a computer system programmed to execute such a method, in which measured isotopic concentration values are acquired at multiple well sites, from multiple regions of each of a plurality of formations. The acquired isotopic concentration values are in the form of a normalized ratio of a heavy isotope to a stable isotope of carbon or hydrogen, for each of a plurality of gas components, at multiple well sites, and for each formation at each measured well site, in isolation from the other formations. For each formation, the isotopic concentration ratios are rank ordered. Groups of similar values that are apparent in the ranking are considered to correspond to the same region of that formation, and the geographical region to which those similar values pertain is identified. An average isotopic concentration ratio is derived for each region, and is used in the allocation of gas production for commingled well flow measurements in that region.

Another embodiment of this invention is implemented in a computerized analysis method, and a computer system programmed to execute such a method, in which allocation is accomplished for commingled well flow measurements produced by three or more formations. Isotopic concentration ratios are obtained for each formation at each well site. For a given well and a selected gas component, a mixing equation for the contributions of formations to that gas component is generated, using normalized molecular weight values to eliminate the effects of inorganic and inert gas components. Monte Carlo analysis of the mixing equation is performed, using random selection of contributions for n−1 of the n formations, with the range of each random selection comprehending the sampled values of other formations. The contribution of the unsampled formation is then solved from the mixing equation, for the measured isotopic concentration ratio for the commingled flow. After a number of sample evaluations, trends of the relationships between pairs of the formation contribution percentages are derived, enabling solution of the mixing curve to reveal the relative contributions.

DETAILED DESCRIPTION OF THE INVENTION

The present invention will be described in connection with its embodiments, namely as implemented into a computer system or network used to allocate production contributions of multiple formations from which produced natural gas is commingled at the wellbore, because it is contemplated that this invention is especially beneficial when used in such an application. However, it is contemplated that this approach can provide similar benefits in other applications, particular those involving the production of hydrocarbons from the earth. Accordingly, it is to be understood that the following description is provided by way of example only, and is not intended to limit the true scope of this invention as claimed.

In addition, embodiments of this invention will be described in connection with the isotopic analysis of natural gas components, and as such is directly applicable to allocation in producing gas wells. However, these embodiments of the invention are also useful for allocating oil production, in that the isotopic concentrations of natural gas entrained in the oil output can be measured and analyzed to provide an allocation of the oil output among the formations. As such, while this description refers to the analysis and allocation of gas production among multiple formations, it is to be understood that these methods and apparatuses can also be used in the allocation of oil production among multiple formations.

Figure 1:
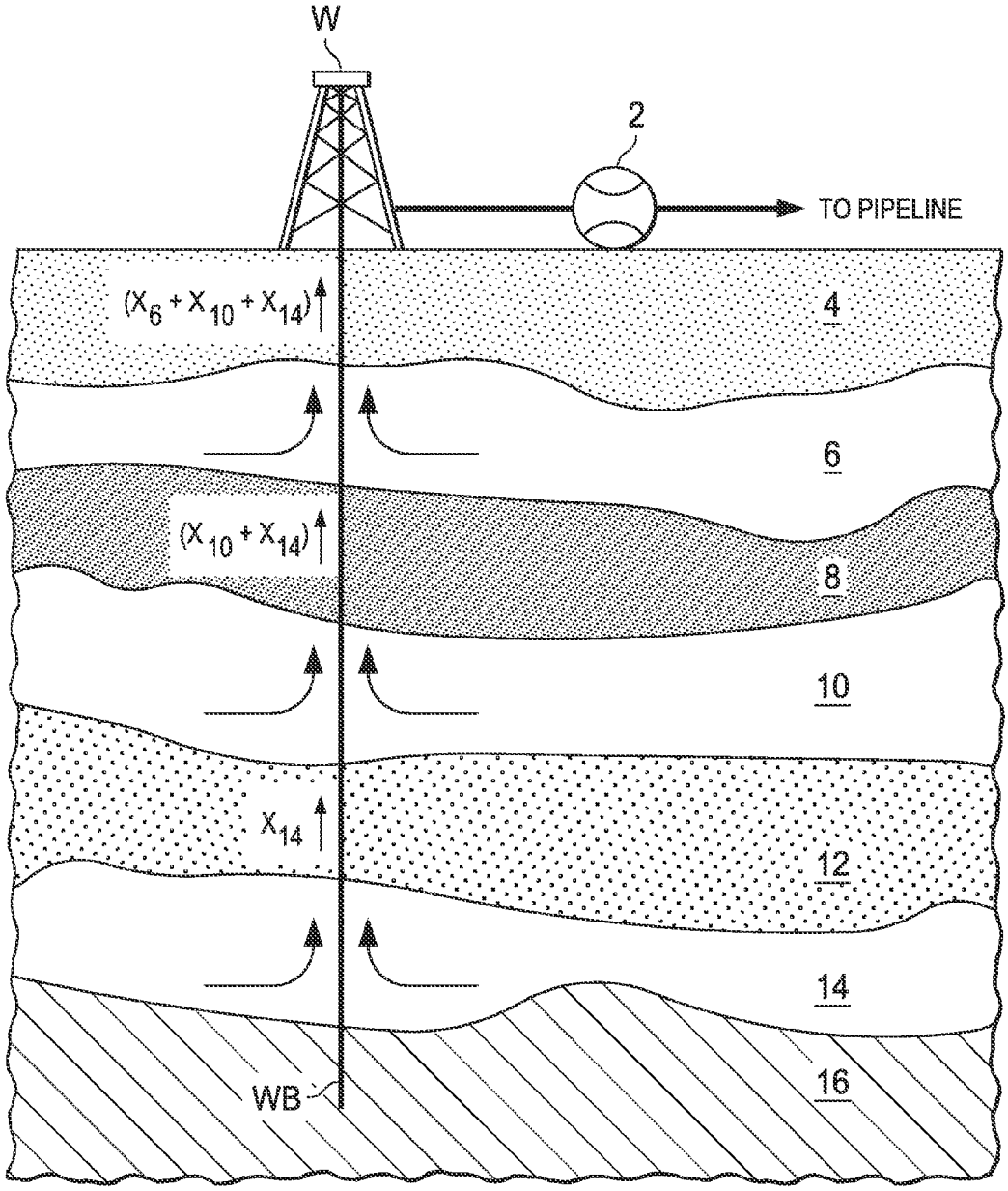
FIG. 1 is an elevation view of a production well, illustrating its production of gas from multiple formations in the earth, and for which embodiments of the invention allocate the production.

FIG. 1 illustrates, in cross-section, an example of a terrestrial production field in which gas well W is in contact with multiple gas-bearing formations, via wellbore WB. In this example, sub-surface formations 4, 8, 12, 16 are non-gas-bearing, and are effectively impermeable to gas. Formations 6, 10, 14 are gas bearing formations in this example. As illustrated schematically in FIG. 1, gas is being produced from each of these formations 6, 10, 14 through perforations into those formations along wellbore WB. As shown in FIG. 1, gas volumes $x_6$, $x_{10}$, $x_{14}$ are produced from formations 6, 10, 14, respectively. These gas volumes $x_6$, $x_{10}$, $x_{14}$ are not necessarily independent from one another, considering that the reservoir pressure in each formation will affect the gas flow from the other formations; in addition, back pressure from the pipeline, changes in downstream tubing size, and other variables will affect the volume of gas produced from each formation. These gas volumes $x_6$, $x_{10}$, $x_{14}$ are commingled into wellbore WB as that gas reaches the surface of the earth.

Flow meter 2 at the surface measures the commingled gas corresponding to the sum ($x_6+x_{10}+x_{14}$) of the gas volumes produced from formations 6, 10, 14. Embodiments of this invention are concerned with identifying the contribution of each of formations 6, 10, 14 to this commingled gas flow measured at flow meter 2, during ongoing production.

Exploratory wells are often drilled at locations in which oil and gas are suspected, in order to identify and assess the oil and gas reservoirs that may or may not be present at one or more depths in those locations. "Development" wells refer to those exploratory wells that are drilled in order to more precisely characterize one or more of the reservoirs at those locations, once the reservoirs have been determined to be commercially viable. As is fundamental in the oil and gas industry, a large number of exploratory and development wells are often drilled into a production field, particularly in developing "tight" gas production fields. These exploratory and development wells tend to be lower cost wells, relative to production wells such as well W shown in FIG. 1. Exploratory and development wells are often "single formation" wells, in that they are drilled to the depth of one of the available formations in the area, so that the oil and gas produced from that formation can be analyzed for its composition; other attributes of that formation, such as reservoir pressure, can also be characterized by way of those wells.

However, some gas production fields are exploited by way of a large number of production gas wells W. For example, some production fields include tens of thousands of wells W, particularly in fields of the type referred to as "tight" gas basins. Measurement data similar to that obtained from exploratory wells can be acquired from those production gas wells W that produce from only single formations.

Of course, while FIG. 1 illustrates a land-based production field, with well W deployed at the surface of the earth, natural gas is also produced from wells that are deployed in the marine environment. Off-shore production of oil and gas is typically accomplished from multiple-well platforms, where the output from multiple wellbores is combined and commingled at the platform, prior to measurement. It is contemplated that these embodiments of this invention will also be applicable to the allocation of gas production in the marine or off-shore context.

Figure 2A:
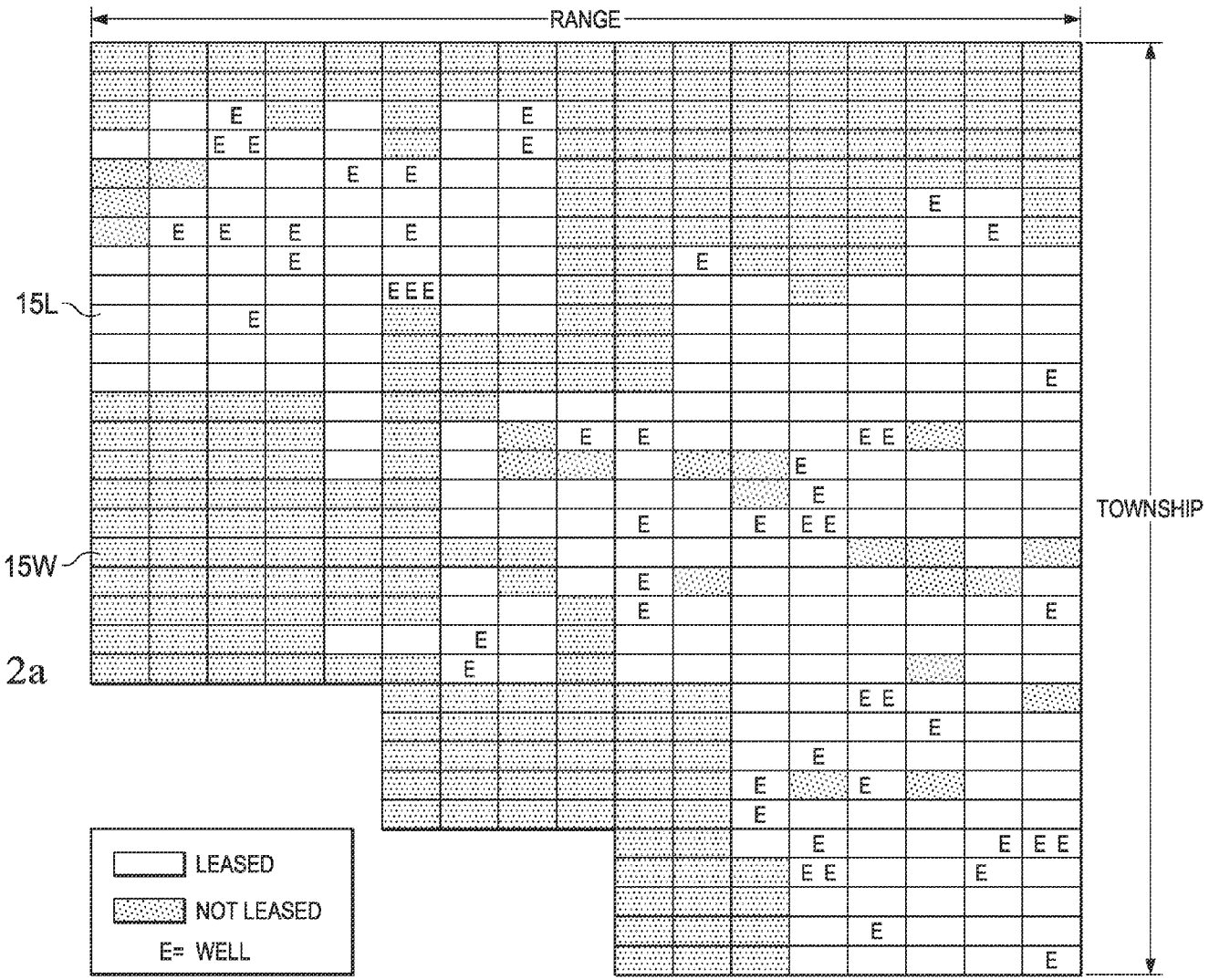
FIGS. 2*a* and 2*b* are maps of a production field, for respective formations, in which embodiments of the invention are implemented.

FIG. 2*a* illustrates an example of the distribution of wells over a region of the earth, which may be exploratory, development, or production wells or any combination thereof. The map of FIG. 2*a* illustrates a number of tracts 15, including tracts 15L for which the oil and gas rights have been leased to a producer, and tracts 15W that are not leased. The locations of tracts 15L, 15W are shown in FIG. 2*a*, arranged by "township" and "range" in the conventional sense. The map of FIG. 2*a* also illustrates wells E that are drilled into a particular formation, for example formation 6 of FIG. 1; in this example, each of these wells E are single formation wells (or can be readily isolated to characterize the flow from a single formation), and as such their output is representative of the output from this formation. In this FIG. 2*a* (and in FIG. 2*b*), the location represented by well E corresponds to the "bottom-hole" location of the corresponding well (i.e., the location at which the well intersects formation 6), rather than the surface location from which the well is drilled.

Figure 2B:
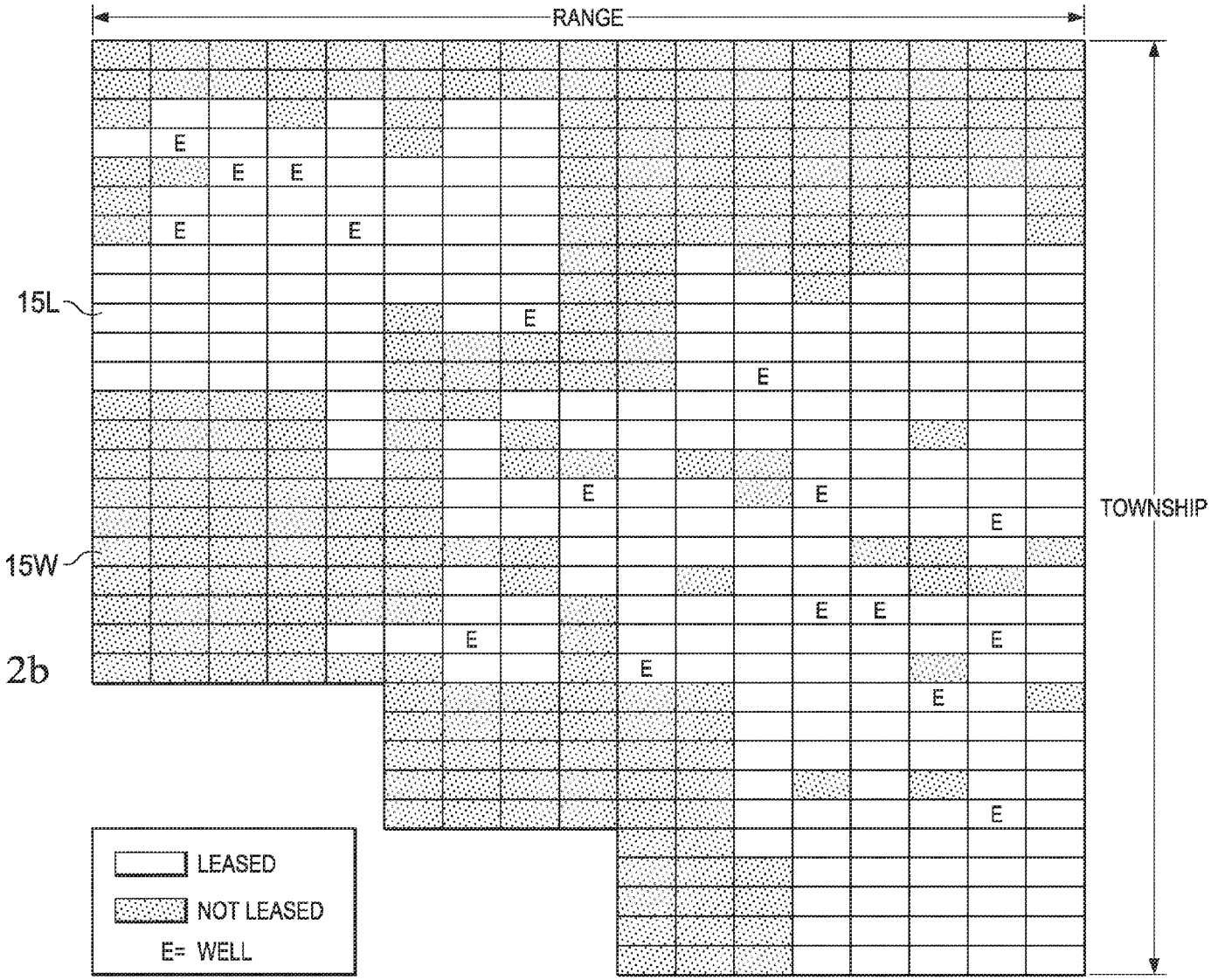

FIG. 2*b* illustrates the same region of the earth as shown in FIG. 2*a*, and the same leased tracts 15L and unleased tracts 15W in the same location. FIG. 2*b* also illustrates the bottom-hole locations of wells E, as drilled into a different formation (e.g., formation 10 of FIG. 1) from that corresponding to wells E in FIG. 2*a*. As evident from a comparison of FIGS. 2*a* and 2*b*, substantially fewer wells E are drilled into formation 10 than were drilled into formation 6 as shown in FIG. 2*a*. This variation in well density often occurs in the evaluation of multiple formations. For exploratory wells, more samples (such as in FIG. 2*a*) may be required to characterize formations that are highly fractured and less uniform; typically, the sampling in such formations tends to be concentrated in higher producing areas of the formation. On the other hand, for those formations that are relatively uniform in output (e.g., formation 10 of FIG. 2*b*), the number and density of wells E can be reduced, while still providing an accurate characterization of the formation output. Other factors regarding the formation, including regulatory constraints, can also affect the number of wells E, whether exploratory or production wells, that intersect a particular formation.

Other approaches to obtaining gas samples from various locations of sub-surface formations are known in the art. As mentioned above, some production wells in a given production field may be single-formation wells, in which case samples of the produced gas can be readily obtained during production. And even for production wells that produce from multiple formations, it is possible to obtain single formation gas samples during the drilling and completion of such wells. Well logs and other downhole tools can also be used to obtain or measure the attributes of gas being produced from such formations. In any case, the acquisition of gas samples for characterization of the composition of gas produced from a formation is a relatively simple process. As a result, in general, a large amount of sample data has been obtained and can be readily obtained from gas-bearing formations of the earth, for potential or actual production fields, in both terrestrial and marine environments.

According to embodiments of this invention, samples of gas produced by wells E are analyzed to determine the isotopic concentration of the gas components produced from each formation individually, at the various locations of the production field from where the samples are taken (FIGS. 2*a* and 2*b*). And according to embodiments of this invention, those single-formation isotopic concentration values are used to enable a precise allocation of gas from commingled well output, for production wells that are drilled into multiple formations in the production field. A specific embodiment of this invention enables this allocation in the case when three or more formations are being produced by a single production well. These embodiments of the invention are automated in the sense that computer systems can be programmed to carry out the analysis of these isotopic concentrations, and the allocation of commingled gas flow, as will now be described.

Figure 3:
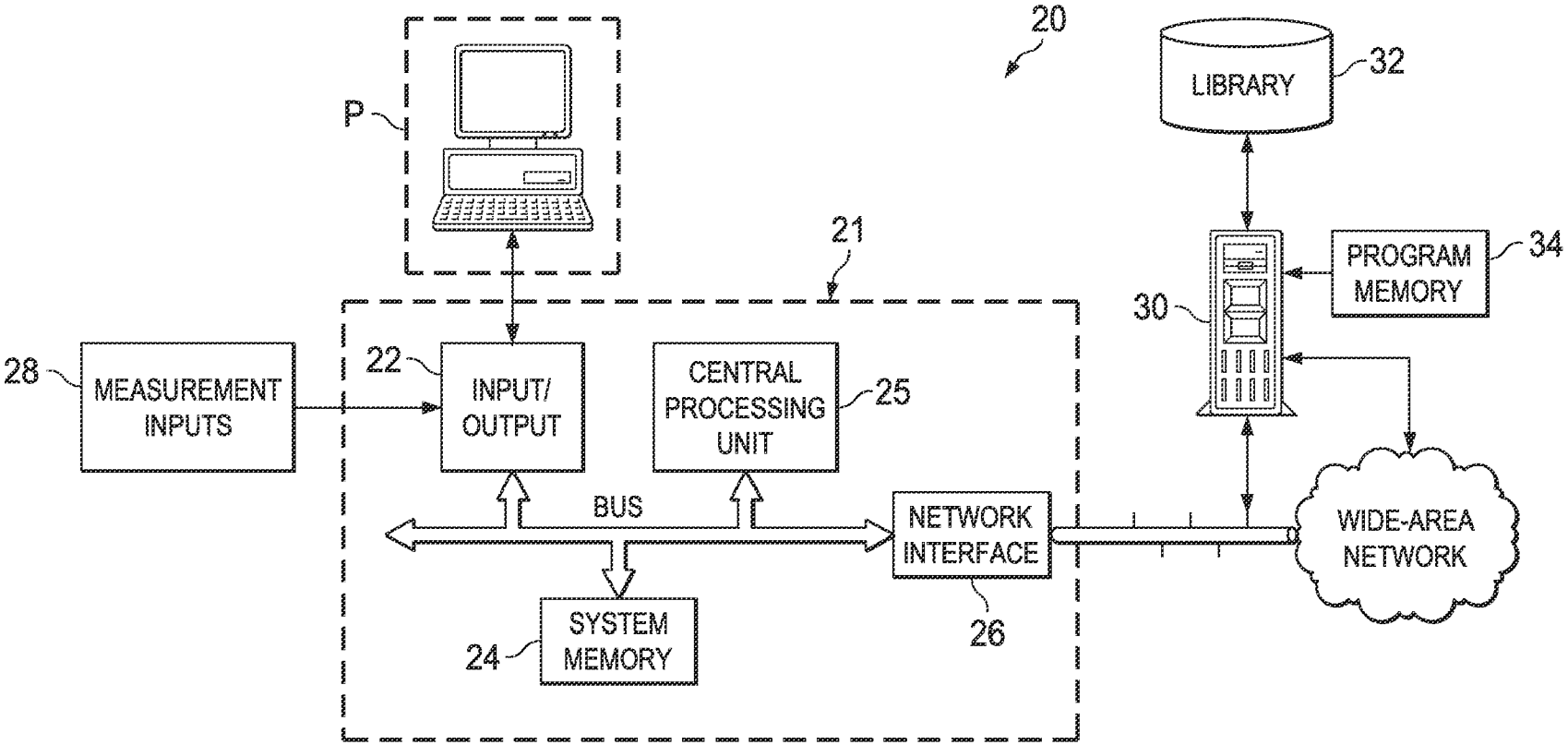
FIG. 3 is an electrical diagram, in block form, of a computerized allocation system, programmed to carry out embodiments of the invention.

FIG. 3 illustrates, according to an example of an embodiment of the invention the construction of allocation system 20, which performs the operations described in this specification to allocate production among the multiple formations contributing to the commingled gas output from a production well. In this example, allocation system 20 is as realized by way of a computer system including workstation 21 connected to server 30 by way of a network. Of course, the particular architecture and construction of a computer system useful in connection with this invention can vary widely. For example, allocation system 20 may be realized by a single physical computer, such as a conventional workstation or personal computer, or alternatively by a computer system implemented in a distributed manner over multiple physical computers. Accordingly, the generalized architecture illustrated in FIG. 3 is provided merely by way of example.

As shown in FIG. 3 and as mentioned above, allocation system 20 includes workstation 21 and server 30. Workstation 21 includes central processing unit 25, coupled to system bus BUS. Also coupled to system bus BUS is input/output interface 22, which refers to those interface resources by way of which peripheral functions P (e.g., keyboard, mouse, display, etc.) interface with the other constituents of workstation 21. Central processing unit 25 refers to the data processing capability of workstation 21, and as such may be implemented by one or more CPU cores, co-processing circuitry, and the like. The particular construction and capability of central processing unit 25 is selected according to the application needs of workstation 21, such needs including, at a minimum, the carrying out of the functions described in this specification, and also including such other functions as may be executed by computer system. In the architecture of allocation system 20 according to this example, system memory 24 is coupled to system bus BUS, and provides memory resources of the desired type useful as data memory for storing input data and the results of processing executed by central processing unit 25, as well as program memory for storing the computer instructions to be executed by central processing unit 25 in carrying out those functions. Of course, this memory arrangement is only an example, it being understood that system memory 24 may implement such data memory and program memory in separate physical memory resources, or distributed in whole or in part outside of workstation 21. In addition, as shown in FIG. 3, measurement inputs 28 that are acquired from laboratory or field tests and measurements are input via input/output function 22, and stored in a memory resource accessible to workstation 21, either locally or via network interface 26.

Network interface 26 of workstation 21 is a conventional interface or adapter by way of which workstation 21 accesses network resources on a network. As shown in FIG. 3, the network resources to which workstation 21 has access via network interface 26 includes server 30, which resides on a local area network, or a wide-area network such as an intranet, a virtual private network, or over the Internet, and which is accessible to workstation 21 by way of one of those network arrangements and by corresponding wired or wireless (or both) communication facilities. In this embodiment of the invention, server 30 is a computer system, of a conventional architecture similar, in a general sense, to that of workstation 21, and as such includes one or more central processing units, system buses, and memory resources, network interface functions, and the like. According to this embodiment of the invention, server 30 is coupled to program memory 34, which is a computer-readable medium that stores executable computer program instructions, according to which the operations described in this specification are carried out by allocation system 30. In this embodiment of the invention, these computer program instructions are executed by server 30, for example in the form of a "web-based" application, upon input data communicated from workstation 21, to create output data and results that are communicated to workstation 21 for display or output by peripherals P in a form useful to the human user of workstation 21. In addition, library 32 is also available to server 30 (and perhaps workstation 21 over the local area or wide area network), and stores such archival or reference information as may be useful in allocation system 20. Library 32 may reside on another local area network, or alternatively be accessible via the Internet or some other wide area network. It is contemplated that library 32 may also be accessible to other associated computers in the overall network.

Of course, the particular memory resource or location at which the measurements, library 32, and program memory 34 physically reside can be implemented in various locations accessible to allocation system 20. For example, these data and program instructions may be stored in local memory resources within workstation 21, within server 30, or in network-accessible memory resources to these functions. In addition, each of these data and program memory resources can itself be distributed among multiple locations. It is contemplated that those skilled in the art will be readily able to implement the storage and retrieval of the applicable measurements, models, and other information useful in connection with this embodiment of the invention, in a suitable manner for each particular application.

According to this embodiment of the invention, by way of example, system memory 24 and program memory 34 store computer instructions executable by central processing unit 25 and server 30, respectively, to carry out the functions described in this specification, by way of which an estimate of the allocation of gas production among multiple formations can be generated. These computer instructions may be in the form of one or more executable programs, or in the form of source code or higher-level code from which one or more executable programs are derived, assembled, interpreted or compiled. Any one of a number of computer languages or protocols may be used, depending on the manner in which the desired operations are to be carried out. For example, these computer instructions may be written in a conventional high level language, either as a conventional linear computer program or arranged for execution in an object-oriented manner. These instructions may also be embedded within a higher-level application. For example, an executable web-based application can reside at program memory 34, accessible to server 30 and client computer systems such as workstation 21, receive inputs from the client system in the form of a spreadsheet, execute algorithms modules at a web server, and provide output to the client system in some convenient display or printed form. It is contemplated that those skilled in the art having reference to this description will be readily able to realize, without undue experimentation, this embodiment of the invention in a suitable manner for the desired installations. Alternatively, these computer-executable software instructions may be resident elsewhere on the local area network or wide area network, or downloadable from higher-level servers or locations, by way of encoded information on an electromagnetic carrier signal via some network interface or input/output device. The computer-executable software instructions may have originally been stored on a removable or other non-volatile computer-readable storage medium (e.g., a DVD disk, flash memory, or the like), or downloadable as encoded information on an electromagnetic carrier signal, in the form of a software package from which the computer-executable software instructions were installed by allocation system 20 in the conventional manner for software installation.

Grouping of Isotopic Concentration Ratio Measurements

According to this embodiment of the invention, the numerous isotopic concentration values that are obtained from well samples are analyzed to identify a primary isotopic indicator, and to identify similar regions of each formation, in order to derive optimal "mixing" expressions from which a formation allocation can be derived from a commingled isotopic concentration measurement.

Figure 4:
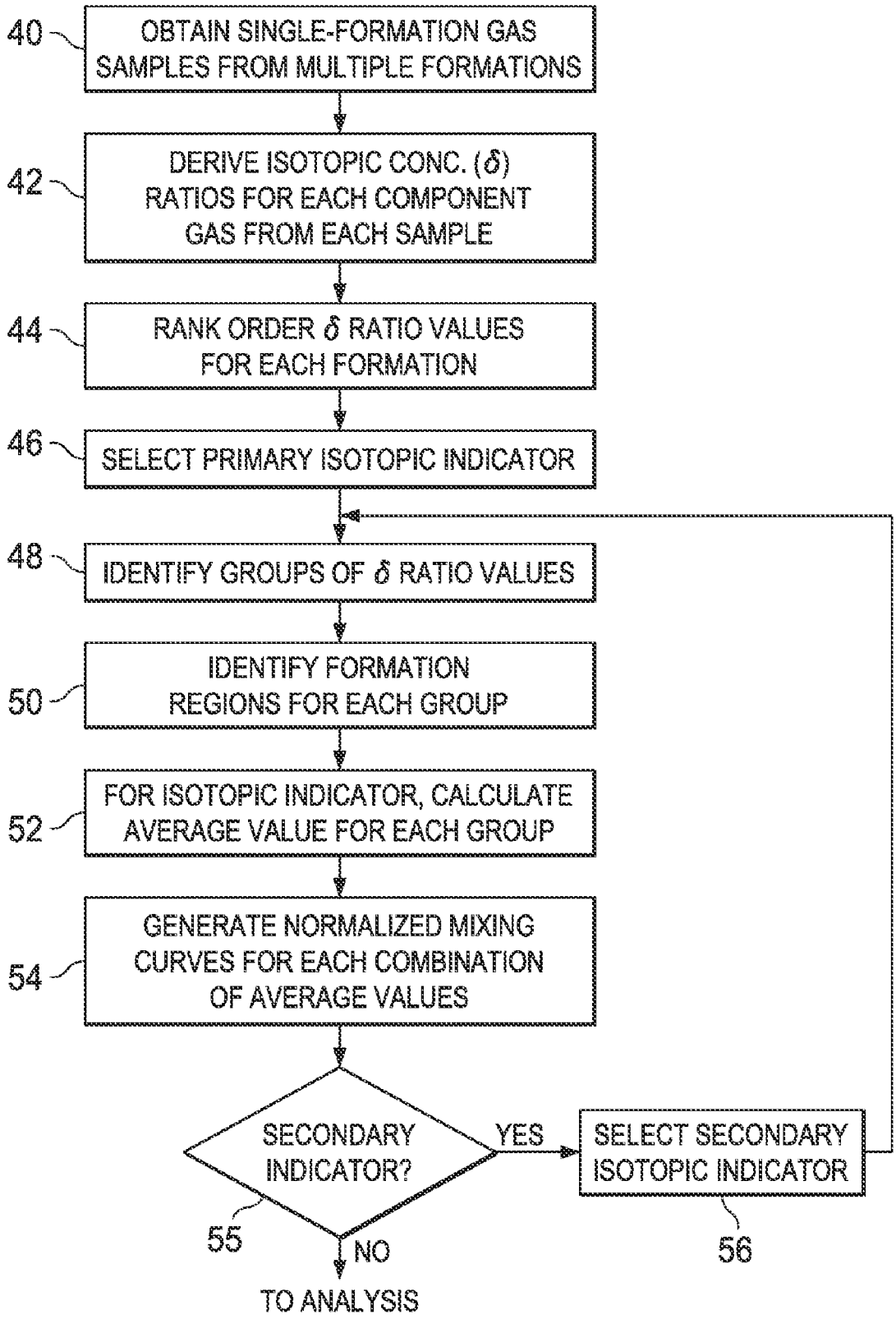
FIG. 4 is a flow diagram of the operation of an embodiment of the invention in connection with deriving mixing curves for the example of the production field and formations of FIGS. 1, 2*a*, and 2*b*.

Referring now to FIG. 4, the operation of allocation system 20 in geographically grouping measured single formation isotopic concentration values, and using these grouped values to produce mixing curves or functions, will now be described in detail. As mentioned above, it is contemplated that the particular calculations may be executed either by workstation 21 or server 30, in the overall allocation system 20 of FIG. 3; in either case, this process will be carried out by way of programmable computing resources (e.g., central processing unit 25 of workstation 21) executing machine readable computer instructions stored in and accessed from program memory within allocation system 20. It is contemplated that those skilled in the art will be readily able to implement these operations and processes within the particular architecture of a computer system.

In addition, the process of FIG. 4 will be described in connection with the generating of mixing curves for two-formation systems, for the sake of clarity. This geographic grouping of measured isotopic concentration values is also useful when more than two formations (e.g., the three-formation lithology shown in FIG. 1) are involved. The generation of mixing functions for the case of three or more producing formations, using these grouped isotopic concentration ratios if desired, will be described in this specification in detail, in connection with another embodiment of the invention.

This operation begins with process 40, in which allocation system 20 obtains measured single-formation isotopic concentration values corresponding to the various wells in the production field. With reference to FIG. 3, these isotopic measurements can be new measurements, in which case these values will be acquired via measurement inputs 28 into input/output function 22 of workstation 21; alternatively, these isotopic measurements may have been previously obtained, in which case workstation 21 (or server 30, as the case may be) can retrieve the measurements from library 32 or some other memory resource. These isotopic measurements can be obtained from gas samples acquired via wells E (FIGS. 2*a* and 2*b*) at the various locations in the production fields, from well logs or other gas samples taken during completion of production wells (from single or multiple formations), from samples of gas taken during production from those production wells that produce from only a single formation, and as obtained by other conventional techniques. In each case, however, it is contemplated that each measured isotopic value obtained in process 40 corresponds to the gas produced from only a single formation, even though multiple formations are present in the production field.

In process 42, allocation system 20 derives isotopic concentration ratios for each component gas in each sample, if these ratios have not been previous derived (e.g., measurements acquired from library 32). The ratio in concentration of heavy isotopes of carbon or hydrogen to the concentration of stable isotopes, in produced natural gas, is an extremely small number. A conventional approach known in the art for conveniently expressing this ratio is based on the ratio of isotopes measured in the produced gas relative to an accepted standard. One example of this normalized manner of expression is the well-known "delta" notation, in which isotope concentration ratios are expressed in parts per thousand deviation from a standard. For example, the ratio of heavy carbon $^{13}C$ to stable carbon $^{12}C$ in a gas sample is commonly expressed, in the delta notation, as:

$$\delta^{13}C_{sample} = \left\{ \frac{\left(\frac{^{13}C}{^{12}C}\right)_{sample}}{\left(\frac{^{13}C}{^{12}C}\right)_{standard}} - 1 \right\} \times 1000$$

In the case of carbon, the standard material corresponding to the denominator of this ratio is typically "Vienna Pee Dee Belemnite", which is a carbonate formation for which the generally accepted ratio of heavy carbon $^{13}C$ to stable carbon $^{12}C$ is 0.0112372. Hydrogen delta ratios are expressed as:

$$\delta D_{sample} = \left\{ \frac{\left(\frac{^{2}H}{^{1}H}\right)_{sample}}{\left(\frac{^{2}H}{^{1}H}\right)_{standard}} - 1 \right\} \times 1000$$

The hydrogen standard material is referred to as "Vienna Standard Mean Ocean Water", for which the generally accepted deuterium to hydrogen ratio is 0.00015575. Accordingly, in process 42, the isotopic concentration values acquired in process 40 are expressed in δ ratio form.

As discussed above, conventional isotopic allocation methods use an average isotopic ratio over the entire formation in distinguishing gas from one formation versus gas in another formation. However, it has been observed, in connection with this invention, that this assumption of uniform concentration ratios over a formation is often incorrect, due to the presence of fractures in the sub-surface formations. Because of these fractures, the locations at which oil and gas are created are not necessary the same locations at which that oil and gas later reside when produced. Accordingly, it has been observed, also in connection with this invention, that the isotopic concentration ratios over a number of wells into a single formation will vary to a significant extent. Conventional isotopic allocation approaches that ignore this intra-formation variation are subject to significant allocation errors, especially in "tight" gas formations. More specifically, this intra-formation isotopic concentration variation can render it difficult to distinguish gas from different formations, because the isotopic concentration of the gas actually produced from a formation may vary from the average to such an extent that its value may approach that of a different formation.

It has also been observed, in connection with this invention, that the isotopic concentration ratios obtained from a number of locations in a formation will tend to cluster into well-defined groups. It has also been observed, in connection with this invention, that the well locations corresponding to the values within these groups correlate geographically with one another, such that particular regions of the reservoir of common isotopic concentration can be readily identified from these groups of measurements. According to this embodiment of the invention, the isotopic concentration value for a formation that is used in performing the allocation of gas production among multiple formations is the isotopic concentration value for the region of the formation from which the commingled well produces gas.

Figure 5A:
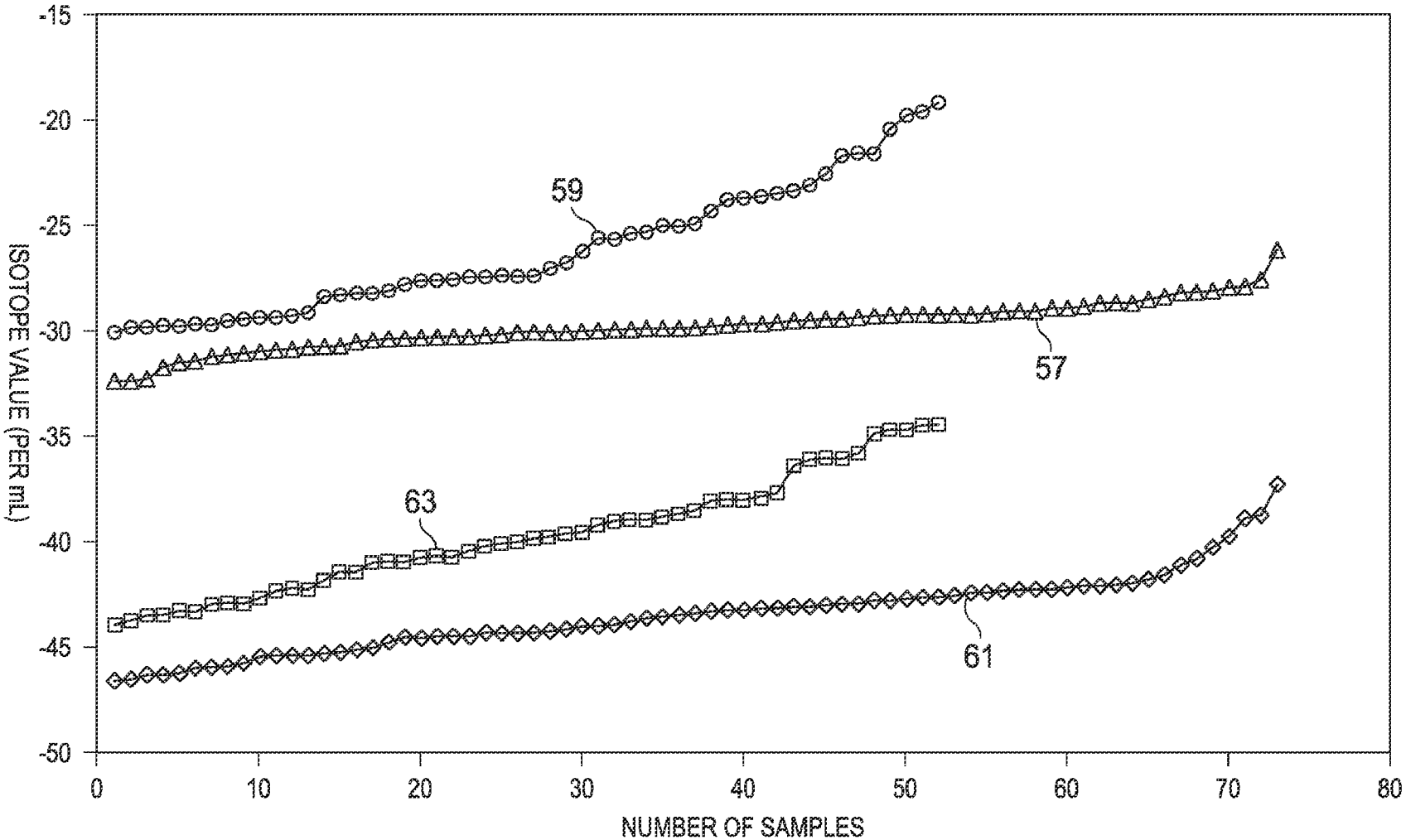
FIGS. 5*a*, 5*b*, and 5*c* are plots of isotopic concentration ratio measurements obtained and grouped according to the process of FIG. 4, in an embodiment of the invention.

This grouping of similar values is created, for the measured isotopic concentration ratios of a given formation, beginning with process 44. In process 44, allocation system 20 rank orders the isotopic concentration ratios for each component gas measured from each formation. A visualized example of this ranking is illustrated in FIG. 5*a*. Plot 57 is the result of process 44, in rank ordering of the isotopic concentration ratios of carbon in ethane ($C_2H_6$, or "C2") gas for measurements from a first formation (e.g., formation 6 of FIG. 1), and plot 59 is the rank order of isotopic concentration ratios of carbon in C2 gas for measurements from another formation (e.g., formation 10 of FIG. 1). Similarly, plot 61 is the rank order of isotopic concentration ratios of carbon in methane ($CH_4$, or "C1") gas from formation 6, and plot 63 is the rank order of isotopic concentration ratios of carbon in C1 gas for measurements from formation 10. For each of plots 57, 59, 61, 63, the vertical axis corresponds to the δ ratio values, and the horizontal axis corresponds to the cumulative number of measurements for each component gas from each formation.

If more than two formations are involved in the allocation process (i.e., for the example of FIG. 1, in which formation 14 also produces gas), then rank ordering process 44 will also be performed for those additional formations. However, for the sake of clarity, the example of FIG. 5*a* illustrates only the rank ordering for the two formations 6, 10. In addition, the isotopic indicators of hydrogen for each component gas, and of carbon and hydrogen for other component gases (C3, i-C4, n-C4 etc.) will also be similarly rank-ordered in process 44.

In process 46, following the rank ordering of process 44, one of the gas component isotopic concentration ratios is selected for use as the primary isotopic indicator, for purposes of analysis and allocation. According to this embodiment of the invention, the selection of a primary indicator can be made according to various criteria. According to one criterion, a minimum separation between the rank order plots of isotopic concentration ratios from the formations is enforced. A greater separation between these plots helps distinguish gas from the respective formations. FIG. 5*a* illustrates an example of this criterion, in which a minimum separation of −2 parts-per-thousand ("per mil") is required. Plots 57 and 59, corresponding to isotopic ratios for C2 gas for formations 6, 10, respectively, fail this criterion. On the other hand, plots 61, 63 of the rank order of isotopic ratios for C1 gas for formations 6, 10, respectively, are separated by more than −2 per mil as rank ordered. According to this example, the primary isotopic indicator selected from the rank ordering shown in FIG. 5*a* will be the carbon isotopic concentration ratio for C1 gas (methane).

Other criteria for selecting the primary indicator can alternatively be used. An example of such another criterion analyzes the combination of statistical measures by selecting the indicator having the smallest standard deviation within each formation, in combination with the largest difference in mean value among formations. This combination can be particularly useful for those cases in which large data sets are not available. Evaluation of this statistical criterion can be carried out by way of an explicit weighting function, or alternatively may be left to the judgment of a human user of allocation system 20.

Following the selection of the primary indicator, the rank ordering results from process 44 for the selected primary indicator are analyzed by allocation system 20, in process 48, to identify groups of the isotopic concentration ratio values for the primary isotopic indicator within each formation. It is contemplated that this grouping of isotopic concentration ratio values will be readily apparent in most formations, such that allocation system 20 can identify the groups of isotopic concentration ratio values in an automated manner, for example by identifying changes in gradient along the rank-ordered results from process 44. Alternatively, it is contemplated that grouping process 48 can be performed by a human user identifying the groups of isotopic concentration ratio values from a visual display of the rank-ordered results from process 44, for example using a graphical user interface and the appropriate input device (mouse, trackball, etc.).

Figure 5B:
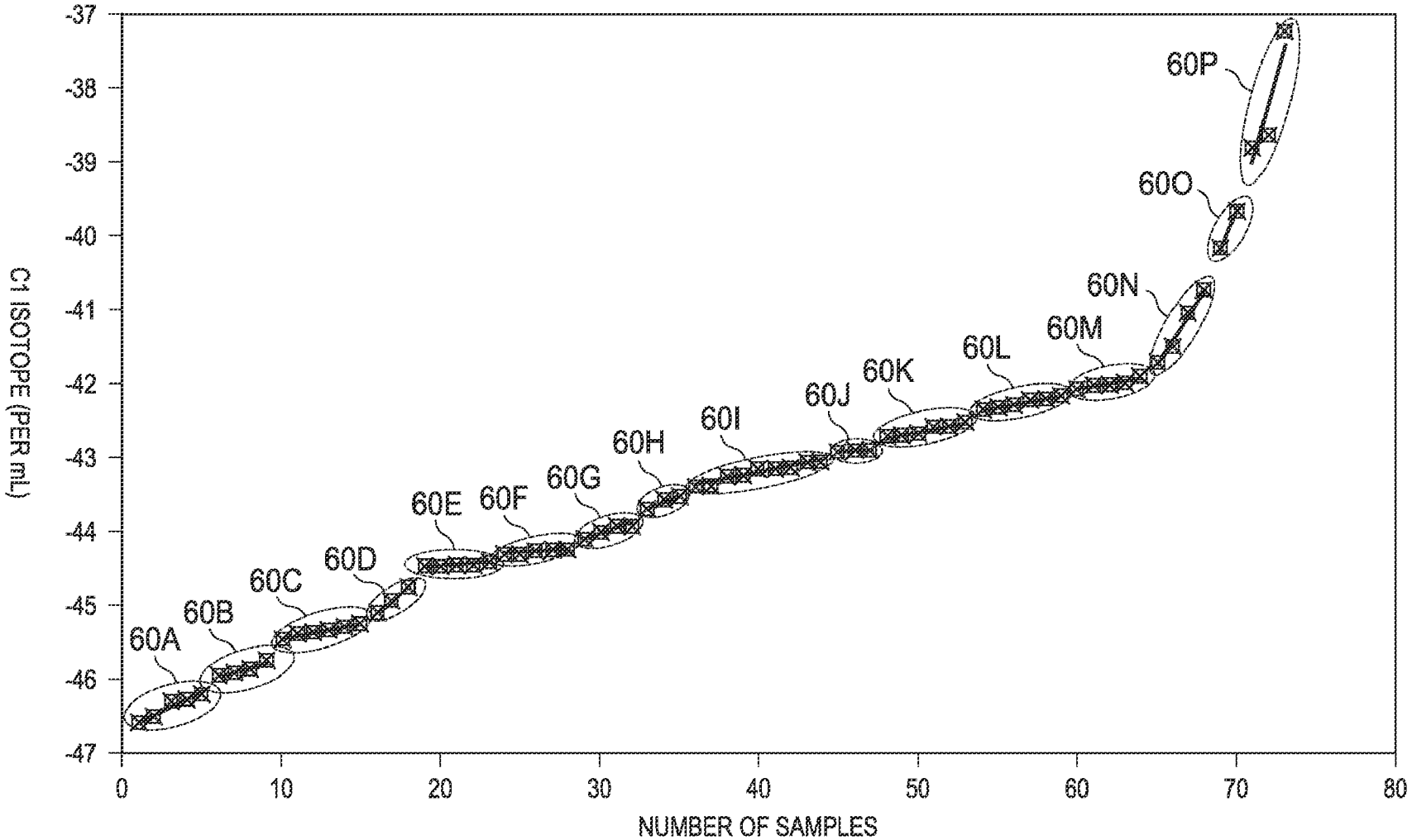
Figure 5C:
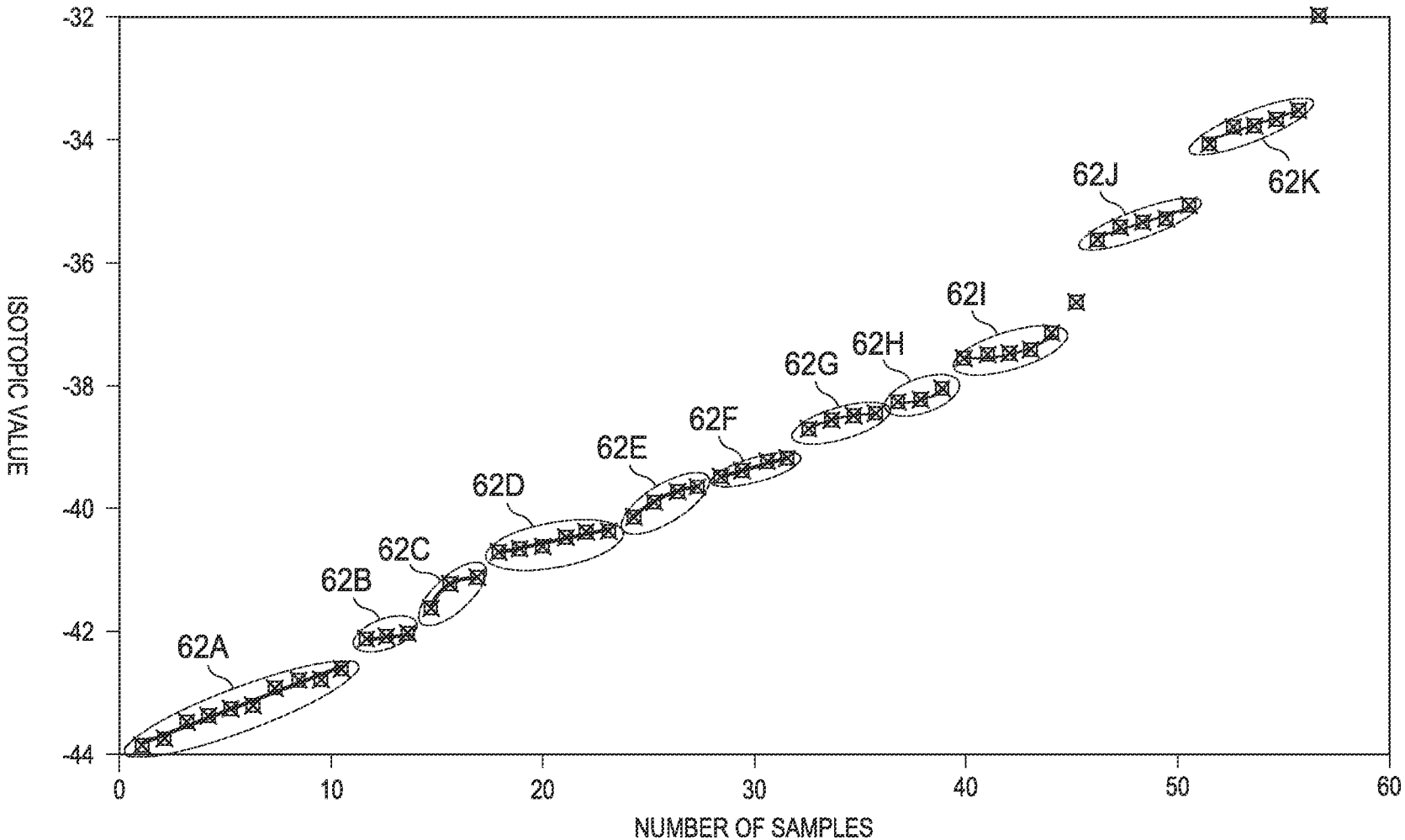

FIGS. 5*b* and 5*c* illustrate an example of the output of grouping process 48, based on the C1 isotopic concentration ratio values that were rank-ordered in FIG. 5*a*. FIG. 5*b* illustrates the grouping results from process 48, as applied to plot 61 for formation 6, with groups 60A through 60O readily apparent and identified in process 48. Similarly, FIG. 5*c* illustrates groups 62A through 62K of the isotopic concentration ratios from plot 63, for formation 10, as identified in process 48. As evident from FIGS. 5*b* and 5*c*, the separation between some of the adjacent rank ordered isotopic concentration ratio values serves to identify the grouped values.

Figure 5D:
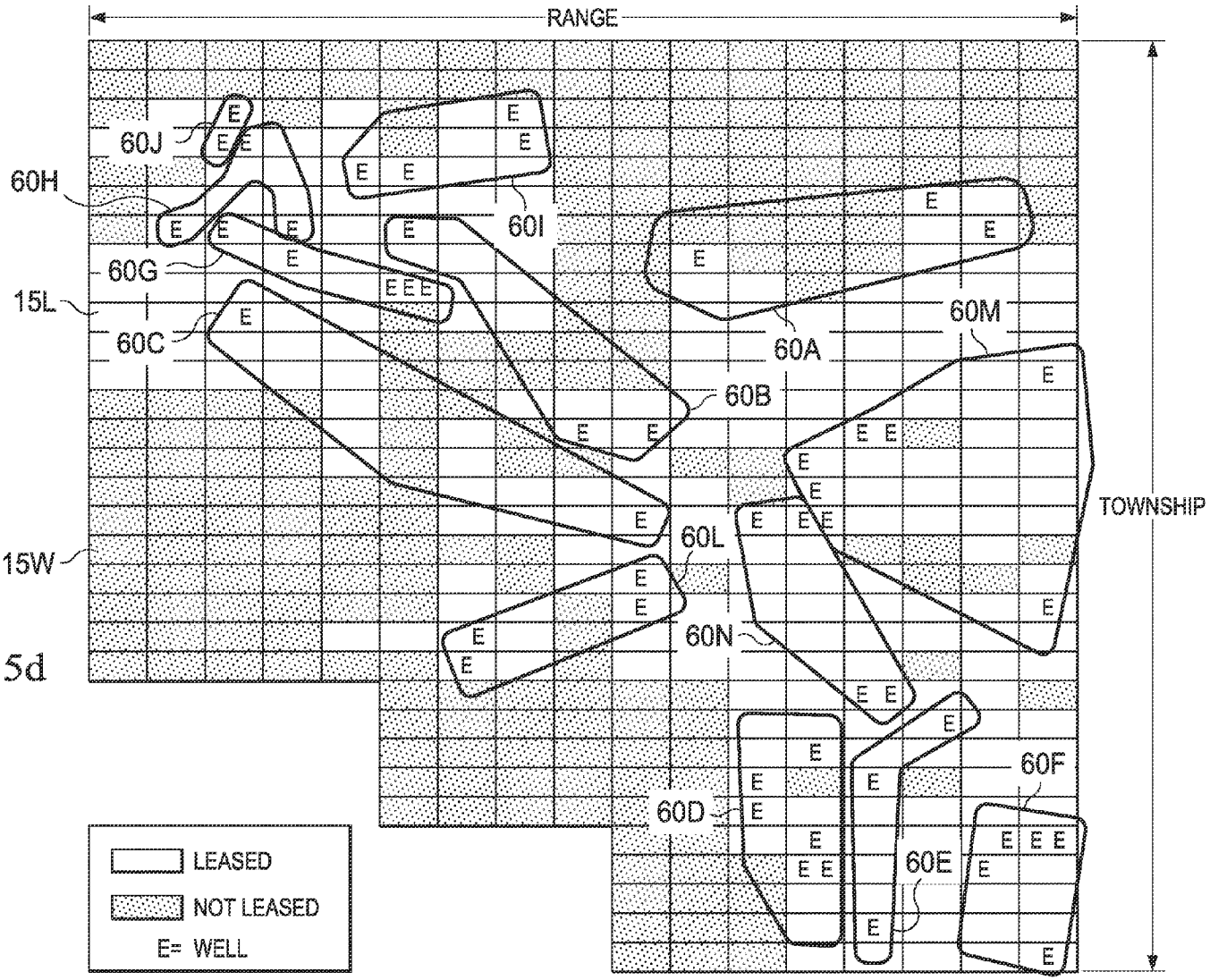
FIGS. 5*d* and 5*e* are maps of the production field of FIGS. 2*a* and 2*b*, respectively, illustrating the grouping of wells according to the process of FIG. 4, in an embodiment of the invention.
Figure 5E:
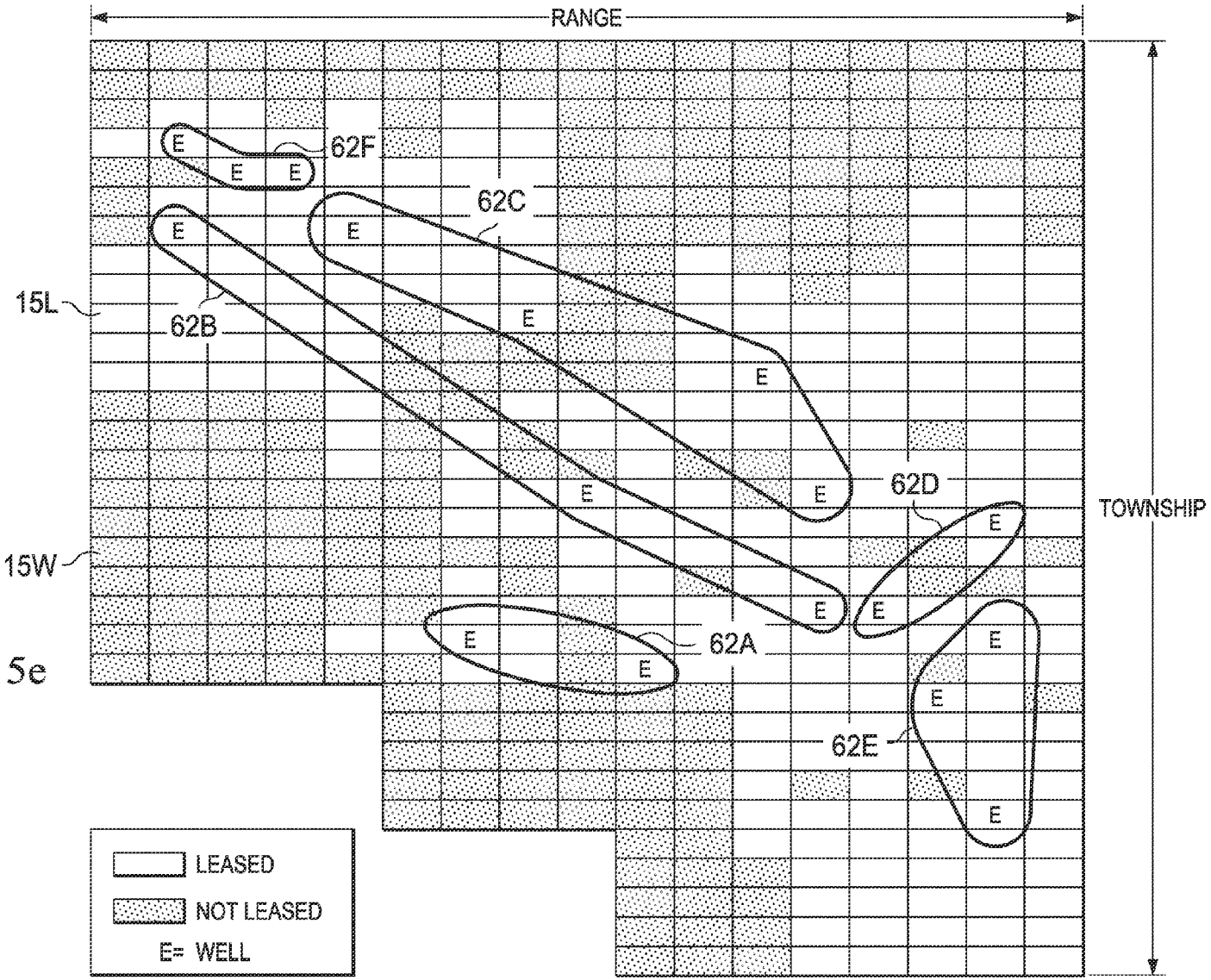

After the groups of isotopic values are identified in process 48, process 50 is then performed to associate the isotopic concentration ratio groups 60, 62 with regions of the corresponding formation, based on the wells E at which the corresponding isotopic concentration ratio measurements were acquired. It is contemplated that process 50 will also be performed by a human user, via a mouse or other pointing device at workstation 21, relative to a graphical display of the results of grouping process 48 and a map of the well locations for the corresponding formation. FIGS. 5*d* and 5*e* illustrate the mapping of groups 60, 62, respectively, to the wells E at which the corresponding measurements were made from formations 6, 10, respectively. As has been observed in connection with this invention, and as shown in FIGS. 5*d* and 5*e*, the locations of wells E from which similar isotopic concentration ratio measurement values are obtained (i.e., the locations of wells E belonging to the same measurement group 60, 62) tend to be near one another geographically, and at a common region of the formation (i.e., a portion of the formation in which the gas is effectively homogeneous in composition, generally at a common depth). Other extrinsic information regarding the field can also be used in constructing the regions in process 50. For example, a known drainage pattern or direction of the production field can inform the human user in aligning the regions. As a result, contiguous areas of similar isotopic measurement values will typically be identifiable, as shown in FIGS. 5*d* and 5*e*. Other information and data extrinsic to the isotopic concentration ratio groups, such as knowledge of the sub-surface geology as may have been determined by seismic surveys and the like, can provide the experienced user with additional assistance in defining the bounds of the mapped groups in process 50.

It is contemplated that the geographical location (i.e., in the x-y plane) of different isotopic concentration ratio groups 60, 62 will not necessarily correlate with one another, as mapped by process 50, because of the underlying structure. For example, group 60A corresponds to the group of isotopic concentration ratio measurements having the most negative value for formation 6, while group 62A is a similar group for formation 6. However, the mapped location of wells E from which the measurements of group 60A were obtained from formation 6 does not geographically correlate to the geographic location of wells E from which the measurements of group 62A were obtained from formation 10. For example, many modern gas wells are directionally drilled, and thus intersect different formations at locations underlying different surface locations; indeed, wells E in FIGS. 2*a* and 2*b* represent the bottomhole locations of the wells (i.e., where each well E intersects the formation) rather than the surface location of the corresponding well. It is therefore quite possible for commingled gas produced by a single well from both of formations 6, 10 to include gas with isotopic concentration ratio values corresponding to any of groups 60, 62.

To facilitate the allocation of commingled gas from production wells W having perforations into the multiple formations, and considering the close uniformity of the isotopic concentration ratios for wells E within a group defined in process 48, allocation system 20 calculates an average isotopic concentration ratio value for each group in process 52. This average value will be used to generate mixing curves or functions according to the embodiments of this invention. It is also useful to calculate, in process 52, some measure of the variation of the isotopic concentration ratio values within each group (e.g., range, standard deviation, variance) for use in estimating a margin of error for the eventual allocation, as will be described below.

In this embodiment of the invention in which two formations are under consideration, allocation system 20 executes process 54 to generate mixing curves for the groups identified in processes 48, 50. According to this invention, these mixing curves are based on the average isotopic concentration ratio values derived in process 52. In this two-formation example, process 54 generates each mixing curve from the average isotopic concentration ratios from each of one identified group 60 of formation 6 and one identified group 62 of formation 10. Mixing curves are produced in this manner for each combination of formation regions (i.e., groups 60, 62) that make reasonable geologic sense, in that it is foreseeable that a production well W may contact that pair of identified regions. In other words, allocation system need not generate a mixing curve for those group pairs corresponding to formation regions into which no reasonable well can be drilled.

According to this embodiment of the invention, process 54 generates mixing curves based on normalized composition analysis of the isotopic concentration ratios, as will now be described. The output of a well is not limited to only hydrocarbons, or hydrocarbon gas. Rather, inorganic substances, inert gases, and other materials that are not of interest in the allocation or analysis of gas production are also produced. Some conventional allocation methods determine two-formation mixing curves using a molecular weight based on the weight percentage of a specific hydrocarbon gas relative to the composite molecular weight of the entire gas produced. It is also known that this "linear" approach to the mixing curves leads to erroneous results in many situations. For two-formation systems, it is known to produce mixing curves in which the molecular weights for the component gases are normalized over the hydrocarbon gases only, excluding the inorganic substances, inert gases, and other materials that are not of interest in the allocation calculations.

Therefore, process 54, in this embodiment of the invention, generates such normalized molecular weights for each of the component gases from each formation 6, 10, in producing the mixing curves. For example, in a gas sample produced from formation 6 in which methane, ethane, propane, i-butane and n-butane gases (C1, C2, C3, i-C4, n-C4, respectively) are produced along with inert and inorganic gases (e.g., hydrogen sulfide, helium, hydrogen, argon, oxygen, carbon dioxide, nitrogen), the normalized molecular weight generated in process 54 for a gas of interest is the molecular weight of that gas as a fraction of the hydrocarbon gases, and excluding the inert and inorganic gases. For example, one can derive the normalized molecular weight of methane (C1) from formation 6 of FIG. 1 as:

$$C1_{norm_fm6} = W_{C1}\frac{C1\%}{C1\% + C2\% + C3\% + iC4\% + nC4\%}$$

where $W_{C1}$ is the molecular weight of methane gas (C1), and where Cx % is the weight percentage of gas Cx in the overall gas produced (including the inert and inorganic gases); iC4% refers to the weight percentage of iso-butane, and nC4% refers to the weight percentage of n-butane (for each species of n-butane being considered). As evident from the examples of isotopic concentration ratios given above, heavy carbon and hydrogen are present in such small concentrations that these isotopes do not affect the overall molecular weight of the gases. These normalized molecular weights are preferably evaluated for each group 60, 62 of formations 6, 10, considering that the data are available from the analysis of the output from each well E.

Figure 6A:
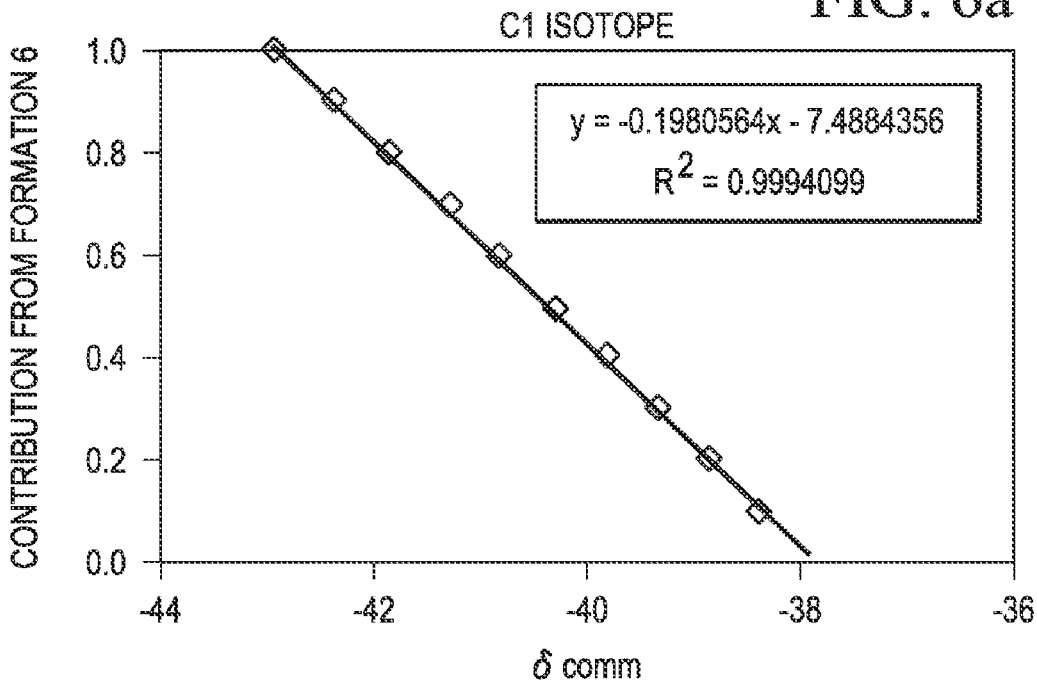
FIGS. 6*a* through 6*c* are plots of mixing curves generated according to the process of FIG. 4, in an embodiment of the invention.
Figure 6B:
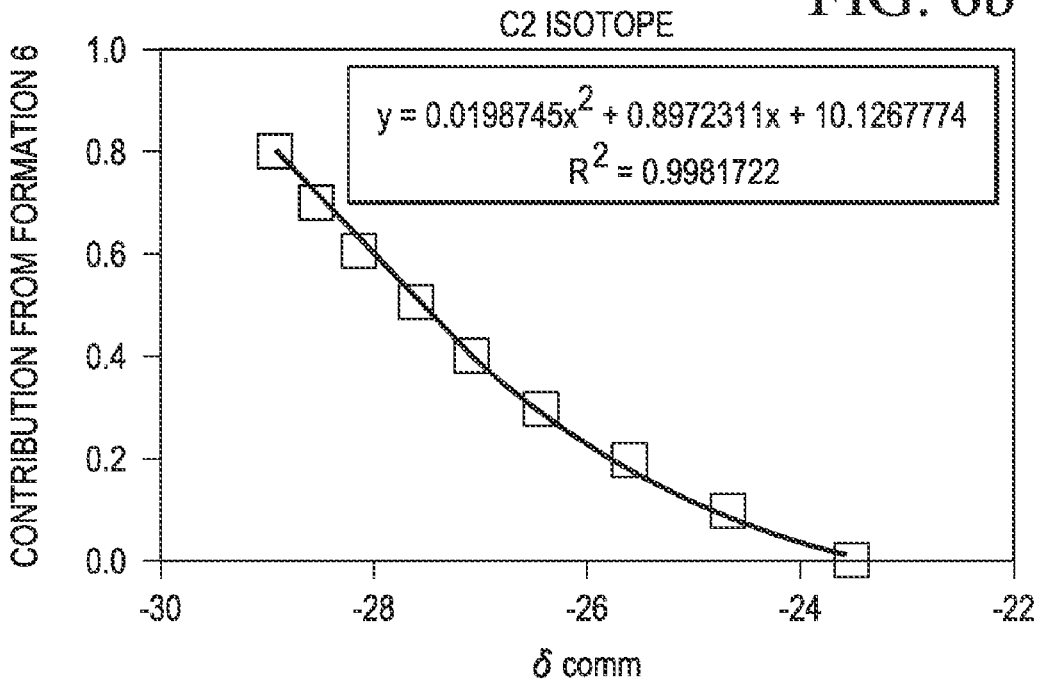

Using these normalized molecular weights, each of the practically possible mixing curves for the primary isotopic indicator gas is then generated by allocation system 20, in process 54. In this example in which production is to be allocated between two formations 6, 10, each mixing curve is derived using the average isotopic concentration ratio value (δ ratio) for the primary indicator for one group 60 of formation 6, and for one group 62 of formation 10. For this two-formation case, each mixing curve is derived by evaluating several points of an equation that calculates the expected commingled isotopic concentration ratio measurement ($\delta_{comm}$) at several mixtures of contributions for the two formations; these mixtures can include the endpoints of 100% contribution from formation 6, and 100% contribution from formation 10. For the example of C1 gas as the indicator, this evaluation is based on the equation:

$$\delta_{commC1} = \frac{((\delta_{C1-6i}\cdot C1_{6i}^{norm}\cdot a) + (\delta_{C1-10j}\cdot C1_{10j}^{norm}\cdot b))}{((C1_{6i}^{norm}\cdot a) + (C1_{10j}^{norm}\cdot b))}$$

where a and b refer to the contributions from formations 6, 10, respectively; $C1_{6i}^{norm}$, $C1_{10j}^{norm}$ refer to the normalized molecular weights of C1 gas from group $\mathbf{60}_i$ of formation 6, and group $\mathbf{62}_j$ of formation 10, respectively; and $\delta_{C1-6i}$, $\delta_{C1-10j}$, refer to the average isotopic concentration ratio measurement derived in process 52 from group $\mathbf{60}_i$ of formation 6, and group $\mathbf{62}_j$ of formation 10, respectively. This expression for the expected commingled isotopic concentration ratio measurement ($\delta_{commC1}$) is evaluated at several points (e.g., formations 6, 10 contributing at 100%-0%, 90%-10%, 80%-20%, . . . 10%-90%, 0%-100%) for the candidate groups $\mathbf{60}_i$, $\mathbf{62}_j$, followed by conventional regression to derive a trend equation best fitting those evaluated points. Preferably, the trend equation expresses the contribution from one of the formations (e.g., formation 6) as a function of the commingled isotopic concentration ratio measurement ($\delta_{comm}$), in the form of a linear or lower-order polynomial expression. This function constitutes the mixing curves generated by allocation system 20 in process 54, for the two candidate groups $\mathbf{60}_i$, $\mathbf{62}_2$. FIGS. 6*a* and 6*b* illustrate examples of observed regression trend lines developed in this manner, for different indicator gases (C1 and C2, respectively) produced from candidate groups $\mathbf{60}_i$, $\mathbf{62}_2$. As evident from the $R^2$ values, linear and quadratic expressions fit the calculated expected commingled isotopic concentration ratio measurement ($\delta_{comm}$) quite well in these examples.

Following the generation of mixing curves for the primary indicator, in process 54, allocation system 20 next evaluates decision 55 to determine whether a secondary indicator remains to be analyzed for purposes of generating mixing curves. According to this embodiment of the invention, the use of both a primary and a secondary indicator to allocate production among multiple formations allows the secondary indicator to verify the allocation based on the primary indicator. If such a secondary indicator is to be used in the eventual allocation process (decision 55 is yes), then processes 48 through 54 are repeated for this secondary indicator. It is contemplated that the grouping (processes 48, 50) of secondary indicator measurements will substantially follow that of the primary indicator grouping, considering that these groups will generally be based on physical separation or isolation of different regions of the sub-surface formations. Mixing curves between various groups in formations 6, 10 for this secondary indicator are thus generated in similar fashion as described above. FIG. 6*b* illustrates such a mixing curve for a secondary indicator (C2 gas), corresponding to the formation regions (groups) from which the mixing curve of FIG. 6*a* was generated for a primary indicator (C1 gas).

Upon completion of the generation of mixing curves for each of the selected indicators (decision 55 is no), allocation system 20 can now analyze a gas sample from the commingled output of a two-formation well, in this embodiment of the invention. This analysis will provide an allocation of the relative contribution of each of the two producing formations (e.g., formations 6, 10), based on mixing curves generated according to the manner described above relative to FIG. 4. As mentioned above, this analysis approach is useful for the allocation of gas production, and also for the allocation of oil production, based on the isotopic analysis of gas associated with that oil production (e.g., gas entrained within the produced oil). An example of the analysis of commingled output for this two-formation situation, according to this embodiment of the invention, will now be described in connection with FIG. 7. As described above, according to this embodiment of the invention, allocation system 20 performs the particular operations in this analysis by way of workstation 21 or by way of server 30. In any case, this analysis will be carried out by way of programmable computing resources within the larger systems of workstation 21 or server 30, those resources doing so by executing machine readable computer instructions stored in and accessed from program memory within allocation system 20. It is contemplated that those skilled in the art will be readily able to implement these operations and processes within the particular architecture of a computer system.

Figure 7:
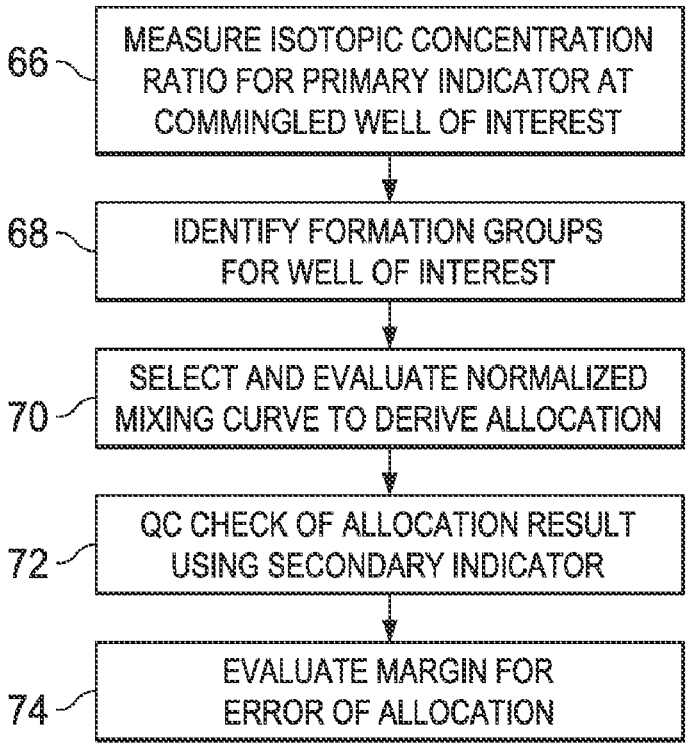
FIG. 7 is a flow diagram of the operation of an embodiment of the invention in allocating commingled production from a well to its formations.

The analysis method illustrated in FIG. 7, according to this embodiment of the invention, begins with process 66 in which the isotopic concentration ratio $\delta_{comm}$ is measured for commingled output from a production or exploration well (i.e., the "well of interest"). For newly acquired samples, this measurement process is performed in the conventional manner, and typically provides isotopic concentration ratios for either carbon or hydrogen or both, for each component gas (methane, ethane, propane, i-butane, n-butane) present in the sample. These measurement values $\delta_{comm}$ are forwarded or otherwise input into workstation 21 as measurement inputs 28 via input/output functions 22 (FIG. 3); workstation 21 can then store data corresponding to these measurement values $\delta_{comm}$ in its system memory 24, or forward the data via network interface 26 to library 32 or some other network-accessible data store. If process 66 is obtaining measurement data for previously acquired commingled samples, then workstation 21 (or server 30, as the case may be) can access those measurements from library 32 or some other storage location accessible via the local- or wide-area network.

In process 68, allocation system 20 identifies the formation groups 60, 62 that the well of interest intersects. Typically, this selection of groups 60, 62 for a given well of interest will correspond with the depth of the regions of formations 6, 10 that are intersected by the well of interest, considering that isotopic variation generally behaves as a function of depth. As such, process 68 can be done in an automated fashion, using extrinsic depth information for the perforations of the well of interest at each formation 6, 10. It is possible that more than one group 60, 62 may correspond to the depth data for a formation 6, 10, respectively; if this occurs, then it is likely that only one group will make geographical sense for the well of interest (i.e., the other candidate groups with similar depth are too far away, geographically). This geographical selection can, of course, be based on the map coordinates or other location information for the well of interest, as coordinated with data representative of the geographical arrangement of the formation groups, for example as discussed above relative to FIGS. 5*d* and 5*e*, for formations 6, 10, respectively. Alternatively, a human user operating workstation 21 can identify the formation groups 60, 62 associated with the well of interest, for example by following a similar depth analysis, confirmed by identifying the geographical location of the candidate groups 60, 62 as viewed on a graphical display of the maps.

Once the formation groups 60, 62 are identified, allocation system 20 executes process 70 to select the mixing curve for this combination of the identified groups from the normalized mixing curves generated in process 54 (FIG. 4) described above, which are stored in library 32 or elsewhere in allocation system 20. This selected mixing curve corresponds to the mixing curve for the primary indicator, at this stage of the process. And once this mixing curve is selected, process 70 is executed by allocation system 20 to evaluate the mixing curve at the measured commingled isotopic concentration ratio $\delta_{comm}$ of the primary indicator that was acquired in process 66. For example, referring to the mixing curve of FIG. 6*a* for the primary indicator of carbon isotopes in C1 (methane), the evaluation of process 70 applies the measured commingled isotopic concentration ratio (e.g., $\delta_{comm}$=−41/mil), and finds the fractional production contribution from the mixing curve at that measurement. In this case, as shown in FIG. 6*a*, the mixing curve returns an allocation of 0.60 (or 60%) of the commingled production) to formation 6 at this commingled isotopic concentration ratio $\delta_{comm}$ of −41/mil, which of course means an allocation of 0.40 (40%) of the commingled production to formation 10, for this well of interest.

Allocation system 20 can perform a "quality control" check of this result by similarly evaluating the mixing curve for an identified secondary indicator gas component, in process 72, by repeating process 70 for that secondary indicator. For example, if carbon in C2 gas (ethane) is the secondary indicator, a mixing curve such as that shown in FIG. 6*b* is selected and evaluated, for the isotopic concentration ratio measurement $\delta_{comm}$ of this secondary indicator as acquired for the commingled sample in process 66. In the example of FIG. 6*b*, this measurement value $\delta_{comm}$ for C2 gas is about −28/mil, which when evaluated for the selected mixing curve, yields an allocation of about 60% from formation 6 and thus about 40% from formation 10, essentially matching the result obtained from the primary indicator analysis shown in FIG. 6*a*. In this case, quality control process 72 indicates that the result from the primary indicator analysis of process 70 can be considered to be reasonable and accurate. This quality check approach can also be used in connection with the selection of the mixing curve, prior to evaluation.

Figure 6C:
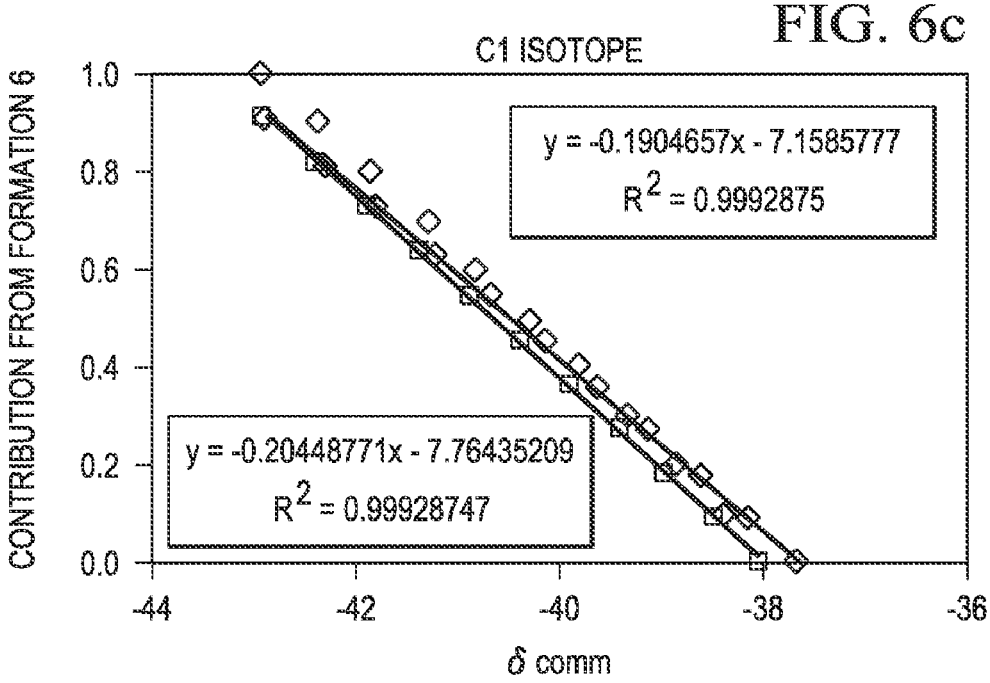

Upon becoming satisfied that the result of the analysis process based on the primary indicator is reasonable, allocation system 20 according to this embodiment of the invention can perform an error analysis on these results, in process 74. For example, according to this embodiment of the invention, a measure of the error can be determined by generating, for the two identified groups 60, 62 from process 68, mixing curves based on the extreme isotopic concentration ratios for those groups, rather than the average values for these groups as used in process 54, adding to each extreme ratio an additional margin corresponding to the expected laboratory error involved in measuring the isotope concentrations. Alternatively, another statistic, such as standard deviation (e.g., ±2σ), can be used to derive the error bound mixing curves. For example, if groups 60C and 62B are identified as the groups for a well of interest, mixing curves can be generated using the minimum and maximum isotopic concentration ratios for groups 60C and 62B, as shown in FIG. 6*c* for the primary indicator of C1 gas. The mixing curves with the widest separation are selected, and evaluated at the measured isotopic concentration ratio $\delta_{comm}$. The allocation results generated in this process 74, from the evaluation of these extreme value mixing curves, provide a measure of the possible error in the allocation calculated in process 70.

The allocation results, and error bands or margin, for the well of interest can now be used in the conventional manner. As mentioned above, allocation between formations in a commingled well can determine a split or sharing of the royalties generated by the commingled well. Knowledge of the relative production output of the individual formations is also useful in reservoir management and well management.

According to this embodiment of the invention, the grouping of isotopic concentration values obtained at various locations in the formations provides a much narrower range of error in the eventual allocation, because the isotopic concentration values used in the mixing curves are more precisely identified geographically and by depth, for the well of interest. By reducing the expected spread over which the isotopic concentration ratio can likely vary, in each formation, the precision of the mixing curve and thus of the allocation calculation is substantially increased over that provided by conventional methods. Better allocation information, and thus improved well and reservoir management actions, are therefore enabled by this embodiment of the invention.

Allocation of Production Among Three or More Formations Producing into a Commingled Well The embodiment of the invention described above is directed to the example of two formations producing into a commingled well. In that case, the mixing curve provides a unique allocation percentage for each measured isotopic concentration ratio, given an isotopic concentration ratio value for the commingled flow. However, many wells produce from three or more formations. In such cases, the measured isotopic concentration ratio for the commingled flow does not yield a single allocation. Effectively, an infinite number of allocations among the three or more formations can exhibit the same measured isotopic concentration ratio in the commingled output.

Figure 8A:
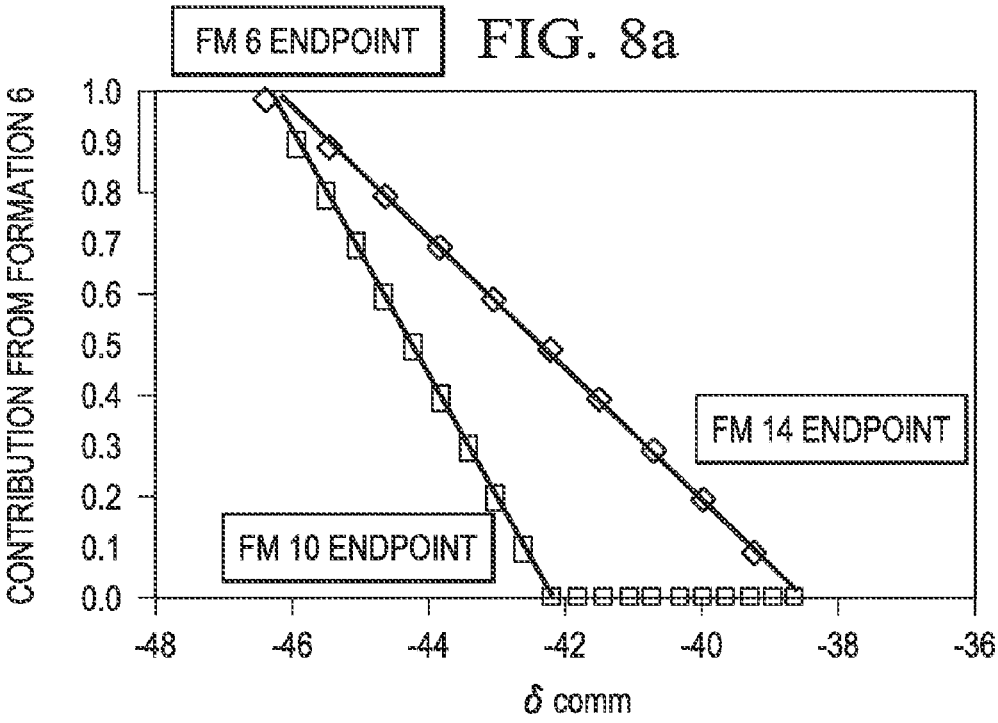
FIGS. 8*a* and 8*b* are plots of mixing curves, illustrating the allocation of production in the case of three formations producing into a commingled well, relative to an isotopic concentration ratio for the commingled flow.
Figure 8B:
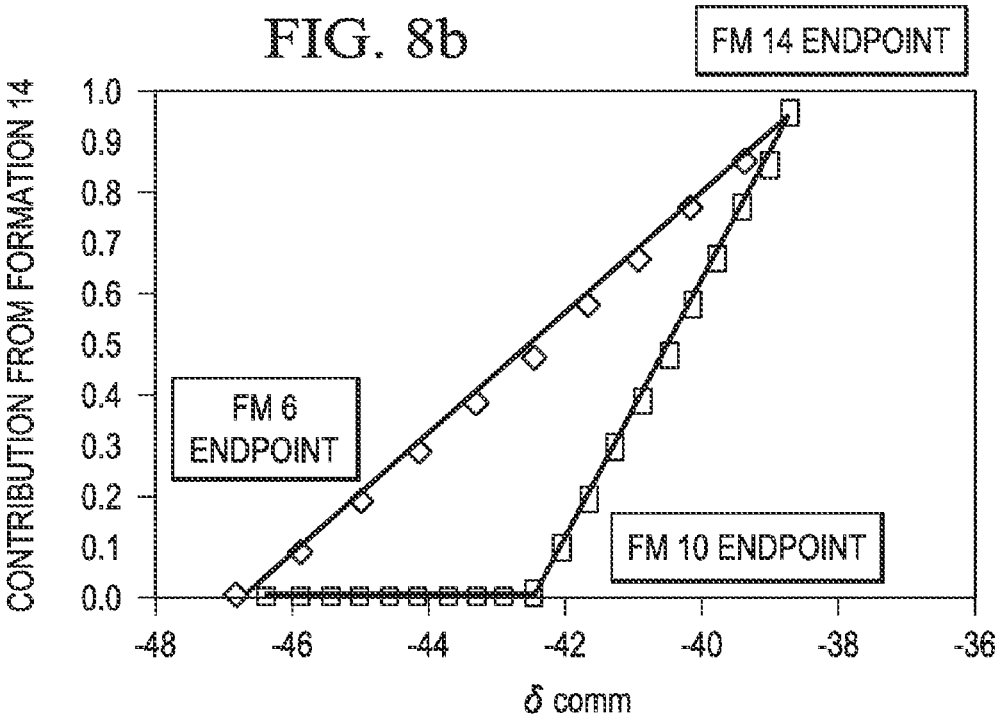

FIGS. 8*a* and 8*b* illustrate this limitation of mixing curve analysis, for the case of the three formations 6, 10, 14 producing gas into well W of FIG. 1. FIG. 8*a* shows the relationship of contribution of gas from one of the formations (formation 6) versus the isotopic concentration ratio $\delta_{comm}$ of the commingled flow from all three formations. As evident from FIG. 8*a*, rather than a single mixing curve, this relationship defines a triangle of possible allocations. For example, at an isotopic concentration ratio $\delta_{comm}$ value of −42/mil, the contribution from formation 6 can vary from zero to 50%. Conversely, a contribution of 30% from formation 6 can be reflected in an isotopic concentration ratio $\delta_{comm}$ ranging from about −43.5/mil to about −41.5/mil, depending on the contributions from the other two formations. A similar indeterminate result occurs for the other formations. FIG. 8*b* illustrates the relationship of contribution from formation 14 versus the isotopic concentration ratio $\delta_{comm}$ of the commingled flow, in which the mixing of gas from the three formations 6, 10, 14 defines a mixing triangle similarly as in FIG. 8*a*. For the example of an isotopic concentration ratio $\delta_{comm}$ value of −42/mil, the contribution from formation 14 can vary from close to zero to about 60%. A similar mixing triangle as those shown in FIGS. 8*a* and 8*b* can, of course, also be derived for the relative production from formation 10. As such, a measurement of isotopic concentration ratio $\delta_{comm}$ in the three formation case is not particularly useful, by itself, in solving the allocation problem, given the wide range of possible allocations. Of course, if a fourth formation also produces into the well, the mixing triangles of FIGS. 8*a* and 8*b* take on another dimension as well.

This underspecified nature of the allocation problem is evident from the conventional mixing equation of a hydrocarbon gas for three formations:

$$\delta_{comm}=(\delta_6 \cdot a)+(\delta_{10} \cdot b)+(\delta_{14} \cdot c)$$

where $\delta_6$, $\delta_{10}$, $\delta_{14}$ are the isotopic concentration ratio endpoint values for this gas from formations 6, 10, 14, respectively, and where a, b, c are the respective fractional contribution of formations 6, 10, 14 to the commingled flow. In this case, since the commingled gas is produced only by the three formations 6, 10, 14, another equation is involved:

$$a+b+c=1.0$$

in that the sum of the contributions a, b, c from formations 6, 10, 14 amounts to the full volume of the commingled gas. In this equation, the three unknowns are the contributions a, b, c from formations 6, 10, 14. However, because only two equations are applicable, this system of equations is underspecified, and no unique solution is directly obtainable.

This embodiment of the invention provides a method for obtaining an estimate of the allocation of gas produced from three or more formations, using isotopic analysis, as will now be described. It is contemplated that this method can be realized by way of one or more computer programs executed by allocation system 20, described above relative to FIG. 3. As mentioned above, it is contemplated that the particular calculations may be executed either by workstation 21 or server 30 in the overall architecture of allocation system 20 of FIG. 3; in either case, this process will be carried out by way of programmable computing resources (e.g., central processing unit 25 of workstation 21) executing machine readable computer instructions stored in and accessed from program memory within allocation system 20. It is contemplated that those skilled in the art will be readily able to implement these operations and processes within the particular architecture of a computer system.

The operation of allocation system 20 according to this embodiment of the invention will now be described, beginning with process 80 in the flow diagram of FIG. 9. As will become evident from the following description, the grouping of isotopic concentration measurements acquired at various locations of the production field, and thus from various regions of each of the formations, as described above, may or may not be performed in connection with this embodiment of the invention. In other words, the allocation of production among three or more formations, according to this embodiment of the invention, can be performed using average values of isotopic concentration ratio endpoints for each formation. However, it is contemplated that the grouping approach described above in this specification will provide improved precision in the allocation process, and as such is well-suited for use in connection with this embodiment of the invention.

The method according to this embodiment of the invention begins with process 80, in which allocation system 20 obtains measured single-formation isotopic concentration ratio measurements from one or more locations of the formations of interest in the production field. As mentioned above, these isotopic measurements can be new measurements, in which case these values will be acquired in the conventional manner and input into workstation 21 as measurement inputs 28, via input/output function 22; alternatively, these isotopic measurements may be retrieved from library 32 or some other memory resource within or accessible to allocation 20.

In process 82, allocation system 20 derives isotopic concentration ratios for each component gas in each sample, if these ratios have not been previously derived; if the ratios have been previously derived, those ratios will be retrieved from memory, such as from library 32. As described above, these isotopic concentration ratios are conveniently expressed in the well-known "delta" (δ) notation of parts per thousand deviation from a standard. Also in process 82, allocation system 20 operates to arrive at an "endpoint" isotopic concentration ratio for each component gas, for each formation. This endpoint isotopic concentration ratio may correspond to an average of the isotopic concentration ratio measurements acquired over the formation, as in conventional isotopic analysis. Other statistics, such as standard deviation, variance, range, and the like can also be generated for each formation from those measurements.

As discussed above in connection with FIGS. 4 through 7, however, the grouping of isotopic concentration ratio measurements, to define regions of the formations, provides improved precision in isotopic allocation that can be beneficial in connection with this embodiment of the invention. As such, process 82 of FIG. 9 can include the operations described above in connection with processes 42, 44, 48, 50, and 52 of FIG. 4, to arrive at average isotopic concentration ratio values for each component gas produced by each of multiple regions of the formations of interest, and also a geographic representation of those formation regions, for example relative to a map view as described above in connection with FIGS. 5*d* and 5*e*. Again, other statistics such as standard deviation, variance, range, and the like relative to each identified region or group can also be generated by allocation system 20 in process 82, for purposes of analysis and also for use in selection of primary and secondary indicators, as will now be described.

As described above, the isotopic concentration ratio endpoint values derived or retrieved in process 82 include such values for each of several component gases, for example including methane (C1), ethane (C2), propane (C3), isobutane (i-C4), and n-butane (n-C4). Typically, the δ ratio varies among the formations 6, 10, 14 for one of these gases to a greater extent than it does for other gases, and as such one of the component gases will better distinguish contributions from among the relevant formations. In process 84, therefore, a primary indicator component gas is selected, based on the derived isotopic concentration ratios in process 82. If the isotopic concentration ratios are being considered over the entire formation (rather than being grouped as described above), a combination of statistical measures may be used to select the primary indicator, for example by selecting the component gas having the best combination of a small standard deviation within each formation 6, 10, 14, and largest difference in mean value among the formations 6, 10, 14. If the grouping approach is being used, this primary indicator may be selected based on a minimum separation between the rank order plots of isotopic concentration ratios from the formations is enforced, as described above relative to FIG. 5*b*. Upon selecting one of the component gases as the primary indicator gas, one or more component gases may be selected as secondary indicators, for purposes of performing a quality check on the allocation of production based on the primary indicator gas.

According to this embodiment of the invention, in process 86, allocation system 20 next derives a mixing equation for the gas production for the selected primary indicator gas. In this case of three or more formations, this mixing equation will thus include three or more unknowns, each unknown corresponding to the contribution from one of the formations of interest into the commingled well output. It has been discovered, in connection with this invention, that conventional assumptions of linearity in the mixing of production from multiple formations especially do not hold in the three or more formation situation. Rather, it has been observed, in connection with this invention, that physical effects and production activities, such as "fracing" of the formation at the wellbore, change the molecular percentage of the primary indicator component gas within the overall gas volume produced, including non-hydrocarbons. According to this embodiment of the invention, therefore, the mixing equation derived by allocation system 20 in process 86 normalizes the molecular weights of the indicator component gas to exclude the effects of non-hydrocarbon gases. An example of such a normalized mixing equation, for the three-formation case in which methane (C1) is the primary indicator, expresses the isotopic concentration ratio $\delta_{commC1}$ for the commingled flow, as:

$$\delta_{commC1} = \frac{\left(\begin{array}{c}(\delta_{6C1}\cdot C1_6^{norm}\cdot a)+(\delta_{10C1}\cdot C1_{10}^{norm}\cdot b)+\\(\delta_{14C1}\cdot C1_{14}^{norm}\cdot c)\end{array}\right)}{((C1_6^{norm}\cdot a)+(C1_{10}^{norm}\cdot b)+(C1_{14}^{norm}\cdot c))}$$

where $\delta_{xC1}$ represents the isotopic concentration ratio endpoint value generated in process 82 for formation x (or particular group or region of formation x corresponding to the location of the well being analyzed), and where a, b, c are the unknowns of the mixing equation corresponding to the relative contributions of formations 6, 10, 14 to the commingled flow. In this expression, $C1_x^{norm}$ represents the normalized molecular weight of the leading indicator gas (e.g., C1 in this case) for formation x (or region x of a formation). This normalized molecular weight is determined, for the example of C1 gas produced by formation 6, by:

$$C1_6^{norm} = MW_{C1}\frac{C1\%}{C1\%+C2\%+C3\%+iC4\%+nC4\%}$$

where $MW_{C1}$ is the molecular weight of methane gas (one C and four H, or 16), where Cx % is the weight percentage of gas Cx in the overall gas produced (including the inert and inorganic gases); iC4% refers to the weight percentage of isobutane, and nC4% refers to the weight percentage of n-butane (for each species of n-butane present). This normalization is, of course, repeated for each of the other formations 10, 14 in this three-formation example. In the general case of n formations of interest (n≧3), the mixing equation derived in process 86 for methane can be expressed as:

$$\delta_{commC1} = \frac{\sum_{i=1}^{n} [\delta_{iC1} \cdot C1_i^{norm} \cdot x_i]}{\sum_{i=1}^{n} [C1_i^{norm} \cdot x_i]}$$

where $x_i$ is the allocation contribution from formation i, and represents the unknowns to be solved according to this allocation method.

In process 88, a measurement of the isotopic concentration ratio for the primary indicator gas is obtained from the commingled flow from the well of interest, that commingled flow including flow from the three or more formations of interest (e.g., formations 6, 10, 14). As before, if process 86 is obtaining measurements from newly acquired samples, this measurement is obtained in the conventional manner through laboratory analysis; typically, this analysis provides isotopic concentration ratios for either carbon or hydrogen or both, for each component gas (methane, ethane, propane, i-butane, n-butane) present in the sample. Allocation system 20 can acquire these new measurement values as measurement inputs 28 into workstation 21 via input/output functions 22 (FIG. 3), in which case workstation 21 stores data corresponding to the measurement values in its system memory 24, or forwards that data via network interface 26 to library 32 or another memory resource. Alternatively, if measurement data for previously acquired commingled samples is being obtained in process 88, workstation 21 or server 30 accesses those existing measurement data from library 32 or some other storage location accessible, via the local- or wide-area network.

According to this embodiment of the invention, for the case of allocation among three or more formations, the analysis works in somewhat a reverse direction from that described above for the two-formation case. In the two-formation case, mixing curves were derived for geographically reasonable combinations of regions of the two formations of interest, and the commingled isotopic concentration ratio measurement was applied as an input to a selected one of those mixing curves. In this embodiment of the invention, the mixing equations and relationships are derived for the specific measured value of the commingled isotopic concentration ratio, rather than in a generalized sense over a range of commingled isotopic concentration ratio values. As will become apparent from the following description, this reverse approach enables solution of the otherwise underspecified system of equations involved in the allocation.

According to this embodiment of the invention, in this three or more formation situation, allocation system 20 evaluates the mixing equation, for the isotopic concentration ratio of the primary indicator gas as measured from the commingled flow, by Monte Carlo analysis process 90. As will be evident from the following description, process 90 will be repeated a specified number of times, that number of times depending on the number of formations contributing to the commingled flow. For example, if three formations are contributing to the commingled flow, one thousand passes through process 90 may be appropriate; if four formations contribute to the commingled flow, as many as ten thousand iterations may be required.

Figure 9:
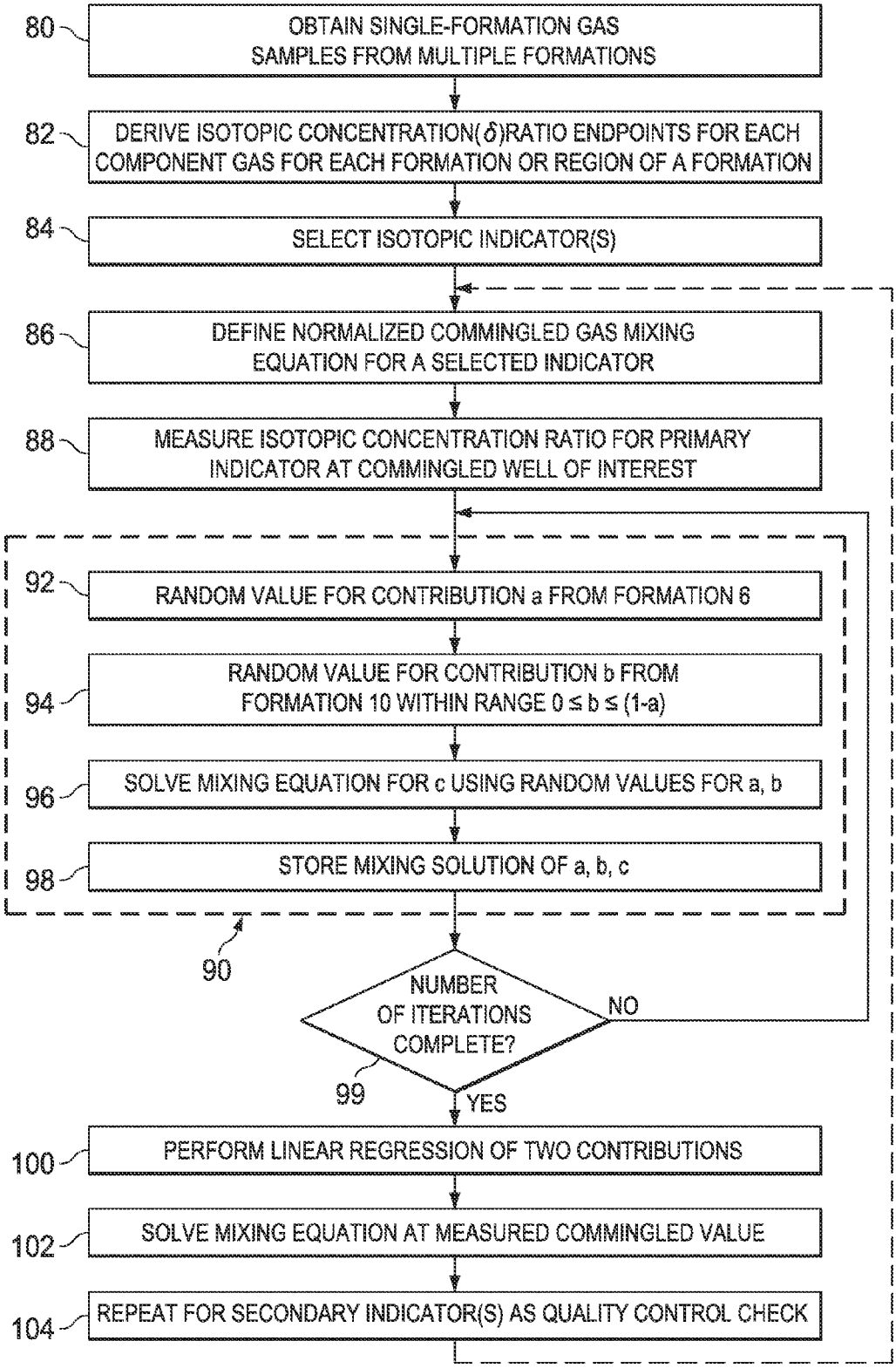
FIG. 9 is a flow diagram of the operation of an embodiment of the invention in allocating commingled production from a well among three or more formations.

In the three-formation example of FIG. 9 for this embodiment of the invention, Monte Carlo process 90 begins with process 92, in which a random value of contribution a from formation 6 is selected. As noted above, the relative contributions a, b, c from formations 6, 10, 14, respectively, are expressed as a fraction of the commingled flow (i.e., a+b+c=1.0). As such, the range from which contribution a is randomly selected in process 92 is 0.0 to 1.0. In process 94, allocation system 20 randomly selects a value for contribution b. The range from which contribution b is selected in process 94 contemplates the value of contribution a selected in process 92 in this same instance of process 90, such that contribution b is selected from the range 0.0 to (1−a). Of course, the particular order in which the relative contributions are randomly selected is unimportant, so long as the range for a subsequently selected contribution contemplates the values of previously selected values.

If Monte Carlo process 90 is being applied to the situation of contribution from four or more formations, random selection of additional contribution values will be performed, from within a range considering the previously-selected random values. For example, the third formation contribution would be selected from within the range 0.0 to 1−(a+b), and so on. This random selection continues n−1 times for the case of commingled flow from n formations, until only the contribution from one formation remains without a value assigned to it.

In process 96, contribution c for flow from formation 14 into the commingled flow remains as the only contribution yet to be determined (randomly or otherwise). According to this embodiment of the invention, in process 96, allocation system 20 solves the mixing equation derived in process 86 for the primary indicator, using the isotopic concentration ratio value $\delta_{comm}$ for the commingled flow as measured in process 88, and using the randomly selected contributions a, b. For the case of methane (C1) as the primary indicator gas, having the mixing equation:

$$\delta_{commC1} = \frac{\left(\begin{array}{c}(\delta_{6C1} \cdot C1_6^{norm} \cdot a) + (\delta_{10C1} \cdot C1_{10}^{norm} \cdot b) + \\ (\delta_{14C1} \cdot C1_{14}^{norm} \cdot c)\end{array}\right)}{((C1_6^{norm} \cdot a) + (C1_{10}^{norm} \cdot b) + (C1_{14}^{norm} \cdot c))}$$

the only unknown remaining, after the random selection of contributions a and b in processes 92 and 94, is contribution c associated with formation 14. As noted above, this mixing equation utilizes the normalized molecular weights for the primary indicator gas, for each of formations 6, 10, 14. Using conventional programming and algebraic techniques, it is contemplated that allocation system 20 can readily solve this mixing equation for contribution c, in this process 96. As a result, one set of contributions a, b, c that satisfies the mixing equation for the primary indicator is derived by this iteration of Monte Carlo process 90. This set of values is stored in memory, in process 98, for use in further analysis as will be described below. Decision 99 is then evaluated to determine whether a desired number of iterations through Monte Carlo process 90 have been completed. If not (decision 99 is no), Monte Carlo process 90 is repeated to obtain another solution to the mixing equations, which of course is another set of contributions a, b, c in this three-formation case.

Figure 10A:
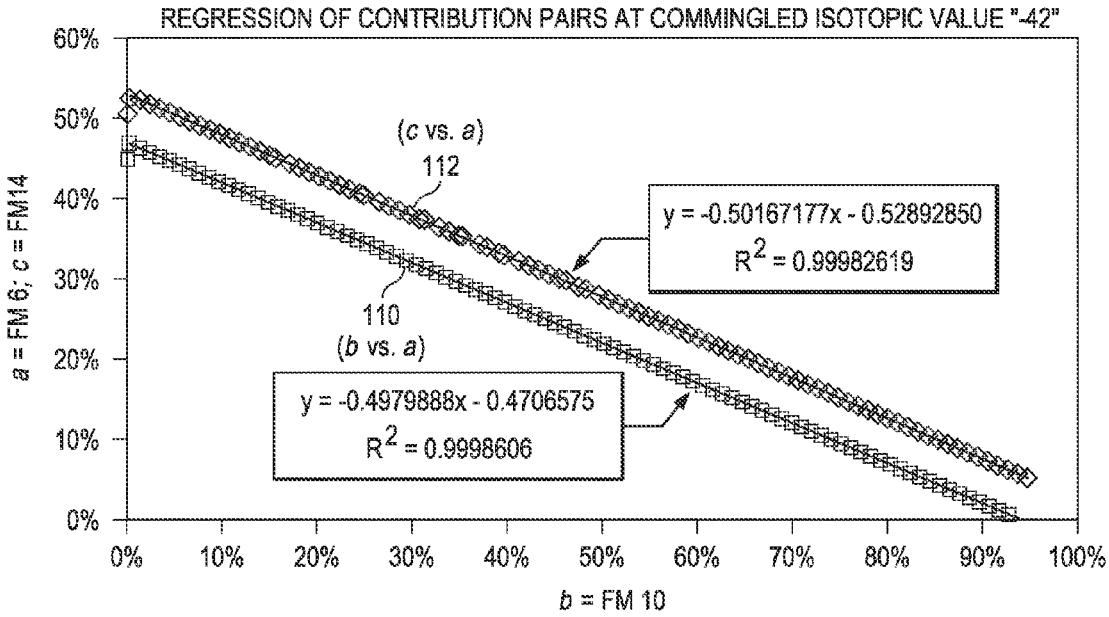
FIGS. 10*a* and 10*b* are plots illustrating regressions of contributions from pairs of formations, as used in allocating production among three formations according to an embodiment of the invention.

Once the desired number of iterations of Monte Carlo process 90 is complete for the current measured isotopic concentration ratio from the commingled flow (decision 99 is yes), allocation system 20 next executes process 100 to generate a regression between a selected pair of the contribution values in the mixing equation solution sets generated in the iterations of Monte Carlo process 90. It is not important which two contributions are selected for regression in process 100. FIG. 10*a* illustrates an example of a pair of regressions performed for an example of this embodiment of the invention, as applied to the three-formation case.

Plot 110 in FIG. 10*a* illustrates an example of a linear regression of contribution a as a function of contribution b, derived from a set of solutions of the mixing equation at a commingled isotopic concentration ratio $\delta_{comm}$ of −42/mil. In this example, the resulting linear regression is:

$$a=-0.497988b+0.4706575$$

The statistic of $R^2$, for linear regression, is the square of the sample correlation coefficient between the two variables. In this regression example, the $R^2$ value is very high, indicating that in this case the linear regression of plot 110 accurately expresses the relationship of the two contributions a, b, for each solution of the mixing equation from the iterations of Monte Carlo process 90, and thus should be closely obeyed by these contributions a, b for any solution of the mixing equation. Plot 112 similarly illustrates the result of a regression of contribution c as a function of contribution b from this same set of solutions of the mixing equation from which plot 110 was generated. Again, excellent correlation and behavior is exhibited by this correlation.

According to this embodiment of the invention, the regression between two of the contributions reduces the number of unknowns in the system of equations defined by i) the mixing curve for the current isotopic concentration ratio $\delta_{comm}$, and ii) the equation a+b+c=1.0. In the three-formation situation, the single regression of process 100 renders the system of equations solvable by allocation system 20, in process 102, as this system can now be expressed as two equations with two unknowns.

According to this embodiment of the invention, process 102 is executed by allocation system 20 to solve for the three contributions a, b, c. In the case where regression process 100 resulted in an expression of contribution a in terms of contribution b, the mixing equation defined in process 86 for the commingled isotopic concentration ratio $\delta_{comm}$ obtained in process 88 can now be expressed in terms of unknown contributions b and c. And because contribution c can be expressed in terms of contributions a and b from:

$$c=1-(a+b)$$

then contribution c can be expressed in terms of contribution b only, by substitution of the regression of process 100 to express contribution a in terms of contribution b:

$$c=1-[(-0.497988b+0.4706575)+b]=0.5293425-0.5020120b$$

Process 102 can then readily solve the mixing equation as expressed in terms of contribution b only, at the measured commingled isotopic concentration ratio $\delta_{comm}$. And because expressions exist for each of contributions a and c in terms of contribution b, then all three contributions a, b, c can be solved in process 102, by allocation system 20 executing computer program instructions reflecting these calculations. This set of contributions a, b, c of course constitutes an allocation of the commingled production flow among the three formations 6, 10, 14 in this example.

In the case of four or more formations contributing to the commingled flow, additional regressions of pairs of contributions will be performed in process 100 to reduce the system of equations to a solvable form. For example, if contributions a, b, c, d from four respective formations are in the commingled flow, then two instances of regression process 100 must be executed by allocation (e.g., expressing contribution a in terms of contribution b, and expressing contribution c in terms of contribution b, as shown in FIG. 10*a*). The system of equations defined by the mixing equation for these four contributions, and by the equation 1.0=a+b+c+d, can then be reduced to two equations in two unknowns, after the two instances of regression process 100 are executed. In general, if the number of contributions in the commingled flow is n, then n−1 instances of regression process 100 are required. Solution of the values of the four or more contributions can then be carried out by allocation process 20 in process 102.

As mentioned above, one or more secondary indicators, corresponding to the isotopic concentration ratio measurements for other component gases in the commingled flow, may also have been selected in process 84. According to this embodiment of the invention, one or more of those secondary indicators may be used to perform a quality control check on the allocation results, in process 104 as executed by allocation system 20. To perform such a quality control check in this process 104, allocation system 20 would effectively repeat processes 86, 88, 90, 99, 100, and 102 for a secondary indicator gas selected previously in process 84. The proximity of the allocation derived, in process 102, for the secondary indicator relative to the allocation based on analysis of the primary indicator will indicate the accuracy of the primary indicator allocation. It is contemplated, of course, that the allocation based on the primary indicator data will be the more accurate estimate, because that primary indicator was selected (in process 84) because of its apparent ability to distinguish contributions from the formations.

According to this embodiment of the invention, an allocation of production in the commingled flow from the well of interest, among three or more formations, is thus solved by allocation system 20. This allocation result is then stored in library 32 or elsewhere within or accessible to allocation system 20, and can be displayed at workstation 21, or otherwise output to the user.

Variations to this embodiment of the invention, in deriving this allocation among three or more formations, will be apparent to those skilled in the art having reference to this specification. One such variation concerns the construction of the mixing equation derived in process 86. In order to simplify the calculations involved, and thus to speed up analysis and execution of the allocation process, the mixing equation derived in process 86 may assume linearity in the mixing of production from the various formations, and thus avoid the determination of the normalized molecular weights as used in the process described above. In this linear case, for the example of contributions from three formations 6, 10, 14 and for methane as the indicator gas, the mixing equation becomes:

$$\delta_{commC1}=(\delta_{6C1}\cdot a)+(\delta_{10C1}\cdot b)+(\delta_{14C1}\cdot c)$$

In the general case for three or more formations, the mixing equation derived in process 86 becomes:

$$\delta_{commC1}=\sum_{i=1}^{n}[\delta_{iC1}\cdot x_i]$$

Figure 10B:
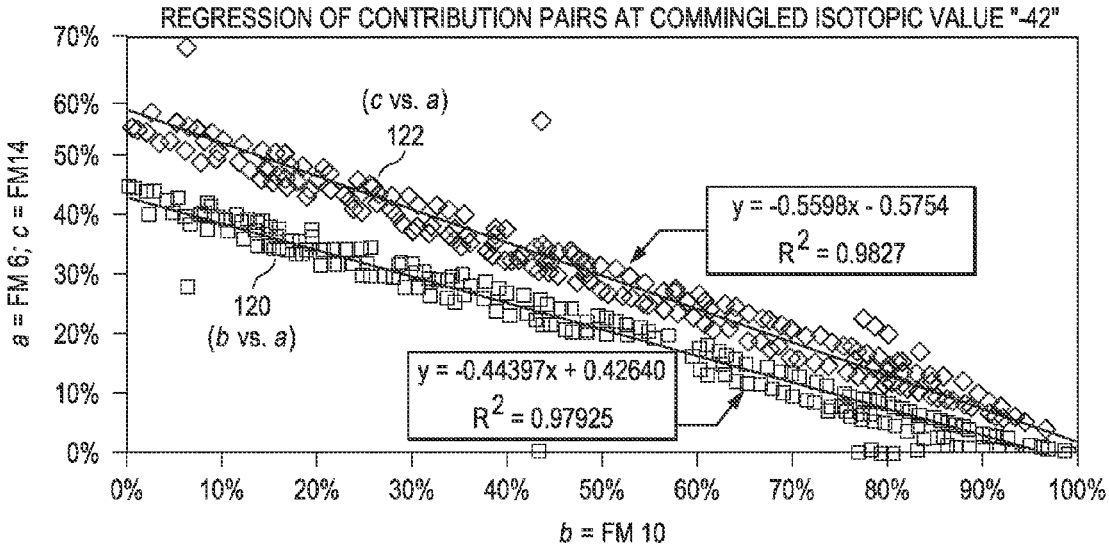

While this simplified expression for the mixing equation facilitates the execution of the allocation process, this linearized approach will tend to insert additional error into the analysis. This error is evident from the poorer correlation exhibited in regression process 100. FIG. 10*b* illustrates an example of the results of regression process 100 for example of pair of regressions from the same situation as described above in connection with FIG. 10*a*, but in which the mixing equation used in FIG. 10*b* is the simplified linearized mixing equation. Plot 120 in FIG. 10*b* again illustrates the linear regression of contribution a as a function of contribution b, and plot 122 illustrates the regression of contribution c as a function of contribution b. In each case, the $R^2$ value for the regressions in FIG. 10*b* is noticeably lower than the corresponding regressions in FIG. 10*a*. This poorer correlation is exhibited by the wider spread of the data values of a vs. b and c vs. b away from their respective regression lines 120, 122. This poorer correlation will be reflected as greater potential error in the eventual allocation, given the wider variation of data points from which the regression expressions are derived. It is contemplated, of course, that those skilled in the art having reference to this specification will be readily able to evaluate the tradeoff between performance and accuracy, in selecting which of the mixing equations forms to use in a particular instance.

IN CONCLUSION

According to the embodiments of this invention, as described herein, a computerized system and method of accurately allocating production of oil and gas among formations in the earth that produce into a single well are provided. As described above, the grouping of isotopic concentration ratio values obtained from each individual formation enables improved geographical correlation and accuracy in the eventual allocation, whether performed between two formations in the earth or among three or more formations. Furthermore, also as described above, another embodiment of the invention enables the precise and efficient allocation of production among three or more formations based on isotopic concentration ratio values, whether such ratios are the average values obtained on a formation-by-formation basis, or obtained by way of the grouping of those values by regions within formations. This improved accuracy of inter-formation allocation of production not only improves the precision of splitting royalties among the formations, but also enables improved visibility into the operation of wells and the reservoir as a whole. As such, it is contemplated that this invention will improve the ability of production operators to manage individual wells and the reservoir in optimizing production from the field.

While the present invention has been described according to its embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of allocating hydrocarbon production among three or more formations produced by a hydrocarbon well, comprising:

obtaining one or more measured values of isotopic concentration from each of three or more formations;

obtaining a measured value of isotopic concentration from a commingled flow of from the hydrocarbon well, the commingled flow including flow from each of the three or more formations;

randomly selecting a contribution, a, for a first one of the formations, wherein a comprises a fraction of the commingled flow in the range of 0 to 1;

randomly selecting a contribution, b, for a second one of the formations, from within a range between 0 and (1−a);

operating a computer to evaluate a mixing equation, the mixing equation corresponding to a relationship of contributions from each of the three or more formations to the isotopic concentration value from the commingled flow, the operating step comprising evaluating the mixing equation at the contributions for the first and second ones of the formations and at the measured value of isotopic concentration for the commingled flow, to provide a contribution for a third one of the formations;

storing a set of contributions for the first, second, and third ones of the formations resulting from the operating step;

repeating the randomly selecting, operating, and storing steps a plurality of times;

operating the computer to derive one or more relationships between each of the one or more selected pairs of the formations, from the stored sets of contributions, so that the mixing equation corresponds to a relationship of a contribution to commingled flow from one of the plurality of formations to the isotopic concentration value from the commingled flow;

operating the computer to evaluate the mixing equation to identify an allocation of production from one of the formations; and operating the computer to evaluate the one or more relationships between one or more selected pairs of the formations to determine an allocation of production for each formation.

2. The method of claim 1, wherein the step of obtaining measured values of isotopic concentration from each of three or more formations is performed for each of a plurality of hydrocarbon component gases;

and further comprising:

selecting one of the hydrocarbon component gases as a primary indicator;

wherein the steps of obtaining a measured value of isotopic concentration from the commingled flow, the randomly selecting steps, the operating steps, the storing step, and the repeating step, are performed for the selected hydrocarbon component gas corresponding to the primary indicator.

3. The method of claim 2, further comprising:

for each of the formations, calculating a normalized molecular weight for the selected hydrocarbon component gas corresponding to the primary indicator, the normalized molecular weight corresponding to a relative fraction of the selected hydrocarbon gas to all hydrocarbon gases produced by the formation;

and wherein the mixing equation for the first hydrocarbon gas weights the relative contribution from each of the formations by a normalized molecular weight for the first hydrocarbon gas for that formation.

4. The method of claim 2, further comprising:

selecting one of the hydrocarbon component gases as a secondary indicator;

repeating the steps of obtaining a measured value of isotopic concentration from the commingled flow, the randomly selecting steps, the operating steps, the storing step, and the repeating step for the selected hydrocarbon component gas corresponding to the secondary indicator; and comparing contributions from each of the three or more formations using the hydrocarbon component gas corresponding to the secondary indicator with the contributions from each of the three or more formations using the hydrocarbon component gas corresponding to the primary indicator.

5. The method of claim 1, wherein the step of operating the computer to derive the relationship between one or more selected pairs of the formations comprises:

operating the computer to perform linear regression of a contribution from one of the formations in the stored sets with corresponding contributions from another of the formations.

6. The method of claim 1, wherein the three or more formations number n formations;

and further comprising, after the step of randomly selecting a contribution for the second one of the formations:

randomly selecting a contribution for another one of the n formations, from within a range between 0 and 1 minus the sum of the previously randomly selected contributions; and repeating the randomly selecting step until randomly selected contributions for n−1 of the n formations have been obtained.

7. The method of claim 6, wherein the step of operating the computer to derive a relationship derives relationships between n−1 pairs of the plurality of formations.

8. The method of claim 1, wherein the step of obtaining measured values of isotropic concentration obtains the measured values from a plurality of locations in each of the three or more formations;

further comprising:

for each of the three or more formations, identifying one or more groups of similar values of isotopic concentration;

for each identified group, calculating an average isotopic concentration value;

repeating the steps of obtaining measured values of isotropic concentration, identifying groups, and calculating average isotopic concentration values, for a plurality of hydrocarbon component gases; and selecting a first hydrocarbon component gas as a primary indicator.

9. The method of claim 8, further comprising:

for each of the three or more formations, calculating a normalized molecular weight for the first hydrocarbon component gas, the normalized molecular weight corresponding to a relative fraction of the first hydrocarbon gas to all hydrocarbon gases produced by the formation from the hydrocarbon well;

and wherein the mixing equation for the first hydrocarbon gas weights the relative contribution from each of the three or more formations by the normalized molecular weight for the first hydrocarbon gas.

10. A computer system, comprising:

an interface for receiving measurement data corresponding to isotopic concentration ratios for one or more hydrocarbon gases produced from three or more formations intersected by a hydrocarbon well, the three or more formations numbering n;

a memory resource;

input and output functions for presenting and receiving communication signals to and from a human user;

one or more central processing units for executing program instructions; and program memory, coupled to the central processing unit, for storing a computer program including program instructions that, when executed by the one or more central processing units, cause the computer system to perform a plurality of operations for allocating production of the hydrocarbon well among the formations, the plurality of operations comprising:

obtaining measured values of isotopic concentration from each of the n formations;

obtaining a measured value of isotopic concentration from a commingled flow of the output of the hydrocarbon well, the commingled flow including flow from each of the n formations;

randomly selecting a contribution, a, for a first formation, wherein the contribution comprises a fraction of the commingled flow between the range of 0 to 1;

repeatedly randomly selecting, n−1 times, an additional contribution for each formation other than the first formation, wherein each additional contribution is a fraction within a range between 0 and (1 minus a sum of a and the additional contribution already selected);

evaluating a mixing equation, the mixing equation corresponding to a relationship of contributions from each of the n formations to the isotopic concentration value from the commingled flow, the evaluating the mixing equation comprising evaluating the mixing equation at the contributions for n−1 formations and at the measured value of isotopic concentration for the commingled flow, to provide a contribution for a remaining formation;

storing a set of contributions for the n formations resulting from evaluating the mixing equation;

repeating the randomly selecting, evaluating, and storing steps a plurality of times;

deriving one or more relationships between each n−1 selected pairs of the formations, from the stored sets of contributions, so that the mixing equation corresponds to a relationship of a contribution to commingled flow from one of the formations to the isotopic concentration value from the commingled flow;

evaluating the mixing equation to identify an allocation of production from one of the formations; and evaluating the one or more relationships between the selected pairs of the n formations to determine an allocation of production for the formations to the commingled flow.

11. The computer system of claim 10, wherein the operation of obtaining measured values of isotopic concentration from each of the n formations is performed for each of a plurality of hydrocarbon component gases;

and further comprising:

selecting one of the hydrocarbon component gases as a primary indicator;

wherein the operation of obtaining a measured value of isotopic concentration from the commingled flow, the randomly selecting operations, the evaluating operations, the storing operation, and the repeating operation, are performed for the selected hydrocarbon component gas corresponding to the primary indicator.

12. The computer system of claim 11, wherein the plurality of operations further comprises:

for each of the n formations, calculating a normalized molecular weight for the selected hydrocarbon component gas corresponding to the primary indicator, the normalized molecular weight corresponding to the relative fraction of the selected hydrocarbon gas to all hydrocarbon gases produced by the formation;

and wherein the mixing equation for the first hydrocarbon gas weights the relative contribution from each of the n formations by a normalized molecular weight for the first hydrocarbon gas for that formation.

13. The computer system of claim 11, wherein the plurality of operations further comprises:

selecting one of the hydrocarbon component gases as a secondary indicator;

repeating the operations of obtaining a measured value of isotopic concentration from the commingled flow, the randomly selecting operations, the evaluating operations, the storing operation, and the repeating operation for the selected hydrocarbon component gas corresponding to the secondary indicator; and comparing contributions from the n formations using the hydrocarbon component gas corresponding to the secondary indicator with the contributions from each of the n formations using the hydrocarbon component gas corresponding to the primary indicator.

14. The computer system of claim 10, wherein the operation of deriving the relationship between n−1 selected pairs of the formations comprises:

performing linear regression of a contribution from one of the n formations in the stored sets with corresponding contributions from another of the n formations.

15. The computer system of claim 10, wherein the operation of obtaining measured values of isotropic concentration obtains the measured values from a plurality of locations in each of the n formations;

wherein the plurality of operations further comprises:

for each of the n formations, identifying groups of similar values of isotopic concentration;

for each identified group, calculating an average isotopic concentration value;

repeating the operations of obtaining measured values of isotropic concentration, identifying groups, and calculating average isotopic concentration values, for a plurality of hydrocarbon component gases; and selecting a first hydrocarbon component gas as a primary indicator.

16. The computer system of claim 15, wherein the plurality of operations further comprises:

for each of the n formations, calculating a normalized molecular weight for the first hydrocarbon component gas, the normalized molecular weight corresponding to the relative fraction of the first hydrocarbon gas to all hydrocarbon gases produced by the formation at the location of the hydrocarbon well;

and wherein the mixing equation for the first hydrocarbon gas weights the relative contribution from each of the n formations by the normalized molecular weight for the first hydrocarbon gas.

* * * * *